US009173468B2

(12) United States Patent
Moloney et al.

(10) Patent No.: US 9,173,468 B2
(45) Date of Patent: Nov. 3, 2015

(54) HAND HELD APPLIANCE

(71) Applicant: Dyson Technology Limited, Wiltshire (GB)

(72) Inventors: Patrick Joseph William Moloney, Malmesbury (GB); Peter David Gammack, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 163 days.

(21) Appl. No.: 13/853,835

(22) Filed: Mar. 29, 2013

(65) Prior Publication Data

US 2013/0283631 A1 Oct. 31, 2013

(30) Foreign Application Priority Data

Mar. 30, 2012 (GB) ..... 1205690.9

(51) Int. Cl.

| | |
|---|---|
| ***A45D 20/04*** | (2006.01) |
| ***A45D 20/10*** | (2006.01) |
| ***A45D 20/12*** | (2006.01) |
| ***F24H 3/04*** | (2006.01) |

(52) U.S. Cl.

CPC ..... *A45D 20/04* (2013.01); *A45D 20/10* (2013.01); *A45D 20/12* (2013.01); *F24H 3/0423* (2013.01)

(58) Field of Classification Search

CPC ..... A45D 20/00; A45D 20/04; A45D 20/10; F24H 3/00; F24H 3/04; F24H 3/0423; F26B 19/00; F26B 21/00

USPC ..... 34/95, 96, 97, 98, 99, 100; 132/221; 392/384, 385; 239/567, 602

See application file for complete search history.

(56) References Cited

U.S. PATENT DOCUMENTS

| | | | |
|---|---|---|---|
| 2,088,189 | A | 7/1937 | Ducart |
| 4,232,454 | A | 11/1980 | Springer |
| 4,350,872 | A | 9/1982 | Meywald et al. |
| 4,409,998 | A | 10/1983 | Bauer |
| 4,596,921 | A | 6/1986 | Hersh et al. |
| 4,635,382 | A | 1/1987 | Bourdeau |

(Continued)

FOREIGN PATENT DOCUMENTS

| | | |
|---|---|---|
| CH | 588 835 | 6/1977 |
| CN | 200973446 | 11/2007 |

(Continued)

OTHER PUBLICATIONS

Search Report dated Jul. 20, 2012, directed to GB Application No. 1205690.9; 1 page.

(Continued)

*Primary Examiner* — Stephen M Gravini
(74) *Attorney, Agent, or Firm* — Morrison & Foerster LLP

(57) ABSTRACT

An appliance, such as a hairdryer, includes a body having a second annular wall extending about a first annular wall which at least partially defines a bore extending through the body. A fluid flow path extends through the bore from a first fluid inlet of the appliance to a first fluid outlet of the appliance. A primary fluid flow path extends at least partially through the body from a second fluid inlet of the appliance to a second fluid outlet, and comprises, within the body, a first section and a second section in which a heater is located. The first section is arranged to direct fluid over an internal surface of at least one of the annular walls. The first section is arranged upstream of, or in parallel with, the second section.

24 Claims, 16 Drawing Sheets

(56) References Cited

U.S. PATENT DOCUMENTS

| | | | | |
|---|---|---|---|---|
| 4,767,914 | A | 8/1988 | Glucksman | |
| 4,800,654 | A | 1/1989 | Levin et al. | |
| 5,133,043 | A | 7/1992 | Baugh | |
| 5,155,925 | A | 10/1992 | Choi | |
| D350,413 | S | 9/1994 | Feil | |
| D352,365 | S | 11/1994 | Hansen et al. | |
| 5,378,882 | A | 1/1995 | Gong et al. | |
| 5,444,215 | A | 8/1995 | Bauer | |
| 5,546,674 | A | 8/1996 | Lange et al. | |
| 5,572,800 | A | 11/1996 | West | |
| 5,598,640 | A | 2/1997 | Schepisi | |
| 5,681,630 | A | 10/1997 | Smick et al. | |
| 5,857,262 | A | 1/1999 | Bonnema et al. | |
| 5,875,562 | A | 3/1999 | Fogarty | |
| 5,956,863 | A | 9/1999 | Allen | |
| 5,996,243 | A | 12/1999 | Chang et al. | |
| 6,148,537 | A | 11/2000 | Altamore | |
| 6,203,349 | B1 | 3/2001 | Nakazawa | |
| 6,591,516 | B2 | 7/2003 | Kamada et al. | |
| 6,751,886 | B2 | 6/2004 | Chang et al. | |
| 6,889,445 | B1 | 5/2005 | Varona et al. | |
| 7,086,176 | B2 | 8/2006 | Lin | |
| D550,813 | S | 9/2007 | Lammel et al. | |
| 7,412,781 | B2 | 8/2008 | Mattinger et al. | |
| 7,913,416 | B1 | 3/2011 | Scieri | |
| D646,354 | S | 10/2011 | Gessi | |
| 8,132,571 | B1 | 3/2012 | Jackson | |
| 8,256,132 | B2 | 9/2012 | Gaillard et al. | |
| D682,472 | S * | 5/2013 | Dyson et al. | D28/54.1 |
| D696,386 | S | 12/2013 | Schoenherr et al. | |
| D702,322 | S | 4/2014 | Sieger | |
| 8,782,920 | B2 | 7/2014 | Marthinsen et al. | |
| D716,492 | S * | 10/2014 | Dyson et al. | D28/13 |
| 8,893,400 | B2 | 11/2014 | Carme | |
| 2004/0163274 | A1 | 8/2004 | Andrew et al. | |
| 2004/0172847 | A1 | 9/2004 | Saida et al. | |
| 2005/0229422 | A1 | 10/2005 | Mattinger et al. | |
| 2006/0075654 | A1 | 4/2006 | Lin | |
| 2007/0294909 | A1 | 12/2007 | Abdi et al. | |
| 2010/0064542 | A1 | 3/2010 | Mulvaney et al. | |
| 2010/0065545 | A1 | 3/2010 | Chung et al. | |
| 2011/0079239 | A1 | 4/2011 | Hall | |
| 2011/0177711 | A1 | 7/2011 | Park | |
| 2011/0203128 | A1 | 8/2011 | Rodrigues | |
| 2011/0219636 | A1 * | 9/2011 | Rowling | 34/97 |
| 2013/0111777 | A1 | 5/2013 | Jeong | |
| 2013/0269200 | A1 * | 10/2013 | Moloney et al. | 34/97 |
| 2013/0269201 | A1 * | 10/2013 | Courtney et al. | 34/97 |
| 2013/0276320 | A1 * | 10/2013 | Courtney et al. | 34/82 |
| 2013/0276321 | A1 * | 10/2013 | Courtney et al. | 34/97 |
| 2013/0283630 | A1 * | 10/2013 | Courtney et al. | 34/97 |
| 2013/0326898 | A1 | 12/2013 | Quessard et al. | |
| 2014/0007448 | A1 | 1/2014 | Courtney et al. | |
| 2014/0007449 | A1 | 1/2014 | Courtney et al. | |
| 2014/0007450 | A1 | 1/2014 | Yao | |
| 2015/0089828 | A1 | 4/2015 | Moloney et al. | |

FOREIGN PATENT DOCUMENTS

| | | |
|---|---|---|
| CN | 100353882 | 12/2007 |
| CN | 201328477 | 10/2009 |
| CN | 201328477 Y | 10/2009 |
| CN | 201341553 | 11/2009 |
| CN | 101292806 | 10/2010 |
| CN | 201774080 | 3/2011 |
| CN | 201948229 | 8/2011 |
| CN | 202146022 | 2/2012 |
| CN | 202536440 | 11/2012 |
| CN | 202774786 | 3/2013 |
| DE | 26 18 819 | 11/1977 |
| DE | 195 27 111 | 1/1997 |
| DE | 10 2009 049 838 | 4/2011 |
| EP | 0 105 810 | 4/1984 |
| EP | 0 300 281 | 1/1989 |
| EP | 0 306 765 | 3/1989 |
| EP | 0 400 381 | 12/1990 |
| EP | 0 970 633 | 1/2000 |
| EP | 1 433 401 | 8/2004 |
| EP | 1 616 500 | 1/2006 |
| EP | 2 000 042 | 12/2008 |
| EP | 2 255 692 | 12/2010 |
| EP | 2 392 223 | 12/2011 |
| EP | 2 401 939 | 1/2012 |
| FR | 1387334 | 1/1965 |
| FR | 1408096 | 8/1965 |
| GB | 647291 | 12/1950 |
| GB | 953057 | 3/1964 |
| GB | 1 446 385 | 8/1976 |
| GB | 1 456 000 | 11/1976 |
| GB | 1 489 723 | 10/1977 |
| GB | 1 539 485 | 1/1979 |
| GB | 2 295 056 | 5/1996 |
| GB | 2 316 868 | 3/1998 |
| GB | 2472240 | 2/2011 |
| GB | 2478927 | 9/2011 |
| GB | 2482547 | 2/2012 |
| GB | 2482548 | 2/2012 |
| GB | 2482549 | 2/2012 |
| GB | 2500798 | 10/2013 |
| GB | 2500800 | 10/2013 |
| GB | 2503684 | 1/2014 |
| GB | 2503685 | 1/2014 |
| GB | 2503686 | 1/2014 |
| JP | 55-113408 | 9/1980 |
| JP | 58-32706 | 3/1983 |
| JP | 60-135700 | 7/1985 |
| JP | 1-27506 | 1/1989 |
| JP | 1-29208 | 1/1989 |
| JP | 4-221507 | 8/1992 |
| JP | 5-7507 | 1/1993 |
| JP | 5-130915 | 5/1993 |
| JP | 7-16113 | 1/1995 |
| JP | 7-155219 | 6/1995 |
| JP | 3014299 | 8/1995 |
| JP | 8-343 | 1/1996 |
| JP | 2000-201723 | 7/2000 |
| JP | 2001-37530 | 2/2001 |
| JP | 2002-238649 | 8/2002 |
| JP | 2003-153731 | 5/2003 |
| JP | 2004-312 | 1/2004 |
| JP | 2004-113402 | 4/2004 |
| JP | 2004-208935 | 7/2004 |
| JP | 2004-293389 | 10/2004 |
| JP | 2004-357763 | 12/2004 |
| JP | 2005-546 | 1/2005 |
| JP | 2006-51181 | 2/2006 |
| JP | 2006-130181 | 5/2006 |
| JP | 2006-181265 | 7/2006 |
| JP | 2007-136121 | 6/2007 |
| JP | 2010-274050 | 12/2010 |
| JP | 2012-45178 | 3/2012 |
| KR | 10-1229109 | 2/2013 |
| WO | WO-83/02753 | 8/1983 |
| WO | WO-94/23611 | 10/1994 |
| WO | WO-2004/006712 | 1/2004 |
| WO | WO-2005/120283 | 12/2005 |
| WO | WO-2007/043732 | 4/2007 |
| WO | WO-2008/053099 | 5/2008 |
| WO | WO-2012/059700 | 5/2012 |
| WO | WO-2012/069983 | 5/2012 |
| WO | WO-2012/076885 | 6/2012 |

OTHER PUBLICATIONS

International Search Report and Written Opinion mailed Jul. 5, 2013, directed to International Application No. PCT/GB2013/050699; 8 pages.

Reba, I. (1966). "Applications of the Coanda Effect," Scientific American 214:84-92.

Courtney et al., Office Action mailed Sep. 24, 2014, directed to U.S. Appl. No. 13/853,739; 12 pages.

Courtney et al., Office Action mailed Jan. 12, 2015, directed to U.S. Appl. No. 13/853,635; 9 pages.

(56) References Cited

OTHER PUBLICATIONS

Courtney et al., Office Action mailed Jan. 13, 2015, directed to U.S. Appl. No. 13/853,739; 11 pages.

Courtney et al., Office Action mailed Apr. 30, 2015, directed to U.S. Appl. No. 13/853,635; 9 pages.

* cited by examiner

H - H

M - M

HAND HELD APPLIANCE

REFERENCE TO RELATED APPLICATIONS

This application claims the priority of United Kingdom Application No. 1205690.9, filed Mar. 30, 2012, the entire contents of which are incorporated herein by reference.

FIELD OF THE INVENTION

This invention relates to a blower and in particular a hot air blower such as a hairdryer.

BACKGROUND OF THE INVENTION

Blowers and in particular hot air blowers are used for a variety of applications such as drying substances such as paint or hair and cleaning or stripping surface layers. Generally, a motor and fan are provided which draw fluid into a body; the fluid may be heated prior to exiting the body. The motor is susceptible to damage from foreign objects such as dirt or hair so conventionally a filter is provided at the fluid intake end of the blower.

SUMMARY OF THE INVENTION

The present invention provides a hairdryer comprising a body having a first annular wall and a second annular wall extending about the first annular wall, the first annular wall at least partially defining a bore extending through the body, a fluid flow path extending through the bore from a first fluid inlet through which a first fluid flow enters the hairdryer to a first fluid outlet for emitting the first fluid flow from the hairdryer, a primary fluid flow path extending at least partially through the body and from a second fluid inlet through which a primary fluid flow enters the hairdryer to a second fluid outlet, the primary fluid flow path comprising, within the body, a first section and a second section, and a heater located in the second section of the primary fluid flow path, wherein the first section of the primary fluid flow path is arranged to direct fluid over an internal surface of at least one of the annular walls, and wherein the first section of the primary fluid flow path is arranged upstream of, or in parallel with, the second section of the primary fluid flow path.

Preferably, the first section is upstream of the second section. It is preferred that the first section is arranged to direct fluid over the internal surface of the second annular wall.

Preferably, the first section is arranged to direct fluid over the internal surface of the first annular wall.

It is preferred that the hairdryer comprises a fan unit located in the fluid flow path, and wherein the fan unit is located downstream of the first section and upstream of the second section.

Preferably, there is a duct for conveying fluid from the first section to the second section. It is preferred that the hairdryer comprises a handle, and wherein the duct extends through the handle.

Preferably, the primary fluid flow path comprises, within the body, a third section arranged to direct fluid over an internal surface of one of the annular walls. It is preferred that the third section is arranged to direct fluid over an internal surface of the first annular wall.

Preferably, the third section is arranged upstream of the second section. Preferably, the third section is in parallel with the first section. Preferably, the third section is in parallel with the second section.

Preferably, the second section and the third section of the primary fluid flow path merge upstream of the second fluid outlet.

It is preferred that the second fluid inlet is located in the body. Preferably, the first annular wall at least partially defines the second fluid outlet. Preferably, the second fluid outlet is arranged to emit fluid into the fluid flow path.

It is preferred that the second fluid outlet extends about the fluid flow path i.e. the fluid flow path is nested or embedded in the second fluid flow path. The primary fluid flow path may be annular to the fluid flow path. Preferably, the fluid outlet of the primary fluid flow path is annular.

It is preferred that the first and primary fluid flow paths are combined within the body as this enables even mixing of the hot fluid from the primary fluid flow path with the entrained fluid from the fluid flow path. Preferably, the fluid flow paths merge within the hairdryer.

Preferably, the second fluid outlet is arranged to emit fluid into the fluid flow path. It is preferred that the second fluid outlet extends about the first fluid outlet. The first fluid outlet is arranged to emit fluid from the hairdryer.

Preferably, fluid is emitted from the hairdryer through each of the fluid outlet of the fluid flow path and the fluid outlet of the primary fluid flow path i.e. both the first fluid outlet and the second fluid outlet of the primary fluid flow path are arranged to emit fluid from the hairdryer.

It is preferred that the first fluid outlet and the second fluid outlet are co-planar.

Preferably, the fluid flow paths are isolated within the hairdryer.

It is preferred that the bore is an external wall of the body of the hairdryer. Preferably, the bore is within the hairdryer body and it defines an external surface along which fluid is entrained. The bore is inside the body and defines a hole through the body. The perimeter of the hole is defined by the body duct. The bore is a single piece or comprises two or more parts which together define the first fluid flow path.

The flow path and the primary flow path upstream of the fan assembly act as heat sinks or thermal exchangers for the primary flow path in the vicinity of the heater. It also results in all the fluid flowing through the body being heated whether actively or passively Preferably, the body comprises a first external wall and a second external wall extending about the first external wall, and wherein the first external wall defines a bore extending through the body, and wherein the fluid flow path extends through the bore.

The hairdryer includes means for acting on fluid flow in the fluid flow path. Such means includes but is not limited to a fan assembly and a heater. The means for acting on fluid flow is also considered to be a processor that processes the fluid that flows, for example by drawing the fluid through the hairdryer, heating the fluid or filtering the fluid flow.

The provision of two flow paths enables fluid that flows through each flow path to be treated differently within the hairdryer.

It is preferred that the means for acting on fluid flow acts indirectly on fluid in the first flow path i.e. on entrained fluid. Thus the first fluid flow path is in thermal communication with or adjacent to the heater and the primary fluid flow path passes through the heater. Likewise, as the fan and motor (the fan assembly) process or act directly on fluid in the primary fluid flow path, fluid in the fluid flow path is indirectly acted upon as it is entrained into the hairdryer by the action of the fan assembly.

The provision of partly drawn in and partly entrained fluid flow through the hairdryer is advantageous for a number of reasons including, as less fluid is drawn in the motor of the fan assembly can be smaller and lighter in weight, the noise produced by the fan assembly can be reduced as there is less flow through the fan, this can result in a smaller and/or more compact hairdryer and an hairdryer which uses less power as the motor and/or heater are only processing part of the flow through the hairdryer.

Ideally, the means for acting on fluid flow acts indirectly on fluid in the first fluid flow path and directly on fluid in a primary flow path. The provision of two flow paths at the inlet end means that only part of the fluid flow through the hairdryer needs to be processed i.e. directly heated or drawn through the fan. This results in less air flow going through the fan which can result in one or more of a quieter hairdryer, a lighter hairdryer, a smaller and/or more compact hairdryer and a hairdryer which uses less power as the motor and/or heater are only processing part of the flow through the hairdryer. For example, the fan and motor can be smaller.

This means that the fan assembly processes a portion of the fluid that is output from the body and the rest of the fluid that flows through the body through the first fluid flow path passes through the body without being processed by the fan assembly. Thus the drawn or processed flow is augmented or supplemented by the entrained flow. The provision of a hairdryer in which the fan assembly only processes part of the flow is advantageous for a number of reasons including, as less fluid is drawn in the motor of the fan assembly can be smaller and lighter in weight, the noise produced by the fan assembly can be reduced as there is less flow through the fan, this can result in a smaller and/or more compact hairdryer and an hairdryer which uses less power as the motor and/or heater are only processing part of the flow through the hairdryer.

The hairdryer can be considered to comprise a fluid amplifier whereby fluid that is processed by a processor (fan assembly and/or heater) is amplified by an entrained flow.

The noise of the hairdryer is reduced by having a long fluid flow path, a coiled/looped/curved/s-shaped/zigzagged fluid flow path and frequency attenuating lining material. However, the use of these features introduces some drawbacks, for example drag in the fluid flow path which can choke the flow and the appliance size is increased. To counteract these drawbacks, the use of partially drawn and partially entrained flow, a fan that only processes around half of the flow is used.

The fluid flow path is nested or embedded in the primary fluid flow path. The primary fluid flow path can be concentric or non-concentric to the fluid flow path.

The fluid flow paths are preferably substantially circular in shape; alternatively they are elliptical, oval, rectangular or square. In fact each flow path may be a different shape or configuration.

It is preferred that there is provided a duct connected to the body, and the primary fluid flow path extends through the duct. Thus the primary fluid flow path is non-linear.

Preferably, the duct comprises a handle portion of the hairdryer. It is preferred that, the primary fluid flow path extends at least partially through each of the handle portion and the body. It is preferred that the fan unit is located inside the duct. The fan unit is for drawing fluid through the second fluid inlet into the primary fluid flow path.

In this embodiment, the fan assembly only processes part, around half, of the fluid flow through the hairdryer so the handle portions of the ducts are able to be of an acceptable diameter for holding comfortably.

The ducts may be circular, however it is preferred that the ducts are non circular i.e. oblate, oval or race track shaped in cross-section. There are advantages to using non circular ducts, the first is that when the duct is used as a handle it can be easier for a user to grip as the oblate or oval shape mimics the shape made by curled figures more precisely than a circular grip, the second is that the non circular shape can be used to impart directionality to the ducts or handles. This directionality can make the hairdryer easier to use. A third advantage is that for a grippable handle, the non circular shape gives a larger cross-sectional area than the circular handle meaning that a greater flow of fluid can pass through the oval handle. This can reduce one or more of the noise produced by the hairdryer in operation, power consumed by the hairdryer and pressure or duct losses within the hairdryer.

Preferably, the duct is lined with a material. Preferably, the material is a foam or a felt. It is preferred that, the material is a sound absorbing material. Alternatively or additionally, the material is a vibration absorbing material and/or an insulator for example a thermal insulator or a noise insulator. The absorbing properties of the material will at least mitigate the property is question and may be tuned specifically to an appliance either by material density or lining thickness for example. The material can additionally be chosen or tuned based on resonant frequencies of the appliance. In this way the appliance can be silenced, or manipulated tonally to improve noise characteristics to a user. The material is preferably around 3 mm thick Preferably, the handle portion of the duct is lined with said material. It is preferred that the lining is continuous around the duct/handle portion. Preferably, the duct comprises a first handle portion and a second handle portion of the hairdryer, and wherein each handle portion is lined with said material.

Preferably, the handle comprises a first handle portion and a second handle portion, and wherein fluid flows through each of the handle portions.

The fan unit is preferably located fluidly between the first handle portion and the second handle portion thus the handle means comprises at least one duct for conveying fluid towards and away from the fan unit.

Preferably, the fluid flow path is accessible to a user.

The invention also provides a hairdryer wherein the heater is inaccessible from the fluid inlet. Preferably, the heater is inaccessible from the second fluid inlet.

The provision of a heater which is inaccessible from the inlet and/or outlet is useful from a safety aspect. If something is inserted into the appliance, it cannot contact the heater directly. An inaccessible heater is also one without direct line of sight from the inlet and/or outlet.

Preferably, the heater outlet is at least 20 mm, preferably 30 mm, more preferably 40 mm, preferably 50 mm or most preferably at least 56 mm from the inlet and/or outlet end of the body of the hairdryer.

Preferably around half of the fluid that flows from the outlet of the hairdryer is drawn through the motor. The rest of the fluid that is admitted out of the outlet of the hairdryer is entrained or induced by the fluid that is processed. The approximately 50% split of drawn to entrained fluid is not essential and can be less or more; the relative fluid flow rates are a function of losses within the duct pathways for each flow path and the configuration e.g. the diameter and cross-sectional areas of the duct pathways.

It is preferred that the fluid flow path passes linearly through the body.

Traditional hairdryers are essentially and open tube with a fan for drawing fluid into the tube. This makes them noisy unless a big and slow fan is used but then a big motor is required which increases weight. The provision of a long fluid flow path through the body and ducting arrangement reduces the noise produced; the provision of a curved, zigzagged, s-shaped or looped fluid flow path (as provided by the two body portions and ducting there between) further reduces the noise produced by the appliance.

A further advantage to having a fan assembly which process some of the fluid flow through the hairdryer and having a fluid flow which is partially drawn and partially entrained is that the ducts through which the processed fluid flows can be of a relatively small diameter. For example for an outflow from the body of around 25 l/s, something like 10 to 12 l/s passes through the ducts and this flow has a maximum velocity of around 25 m/s. As the ducting has a smaller diameter than would be required for full processing of the fluid, silencing of noise produced by the fluid flow through the primary fluid flow path is effective over a larger range of frequencies than for a larger diameter duct. Thus, airborne noise is attenuated to a higher frequency. This is because a duct diameter of less than around half a wavelength promotes planar wave behavior.

It is preferred that a filter is provided for filtering the primary fluid flow path. This has the advantage that less filter material is used than if the whole body inlet were covered. In addition, it provides a line of sight through the central aperture of the hairdryer that is not obscured by filter material. A filter includes one or both of a grill and a mesh material positioned across the primary fluid flow path before fluid flows into the fan assembly.

Preferably, the filter is located upstream of the fan unit. It is preferred that the fan unit comprises a motor, and the filter is located upstream of the motor. Thus, the filter filters fluid before it reaches the motor and preferably before the fluid reaches the fan unit i.e. a fan and a motor, thus the filter is a pre-motor filter. This means the filter protects the motor from the ingress of foreign objects into the fluid flow path which may be detrimental to the motor examples of such objects are hair, dirt and other lightweight objects than may be sucked into the fluid flow path by the action of the fan.

Preferably, the filter is located upstream of the heater.

Preferably, the filter is located at, or adjacent, the second fluid inlet.

Preferably, the heater is annular in shape. It is preferred that the heater is tubular in shape.

Preferably, one or more of the inlet and outlet can be used to store the hairdryer. For example the inner opening can be located onto a retainer such as a hook or nail for convenient storage and retrieval as required.

The invention also provides, an appliance comprising a body having a first annular wall and a second annular wall extending about the first annular wall, the first annular wall at least partially defining a bore extending through the body, a fluid flow path extending through the bore from a first fluid inlet through which a fluid flow enters the appliance to a first fluid outlet for emitting the first fluid flow from the hairdryer, a primary fluid flow path extending at least partially through the body and from a second fluid inlet through which a primary fluid flow enters the appliance to a second fluid outlet, the primary fluid flow path comprising, within the body, a first section and a second section, and a heater located in the second section of the primary fluid flow path, wherein the first section of the primary fluid flow path is arranged to direct fluid over an internal surface of at least one of the annular walls, and wherein the first section of the primary fluid flow path is arranged upstream of, or in parallel with, the second section of the primary fluid flow path.

BRIEF DESCRIPTION OF THE DRAWINGS

The invention will now be described, by way of example only, with reference to the accompanying drawings, in which.

DETAILED DESCRIPTION OF THE INVENTION

Figure 2:
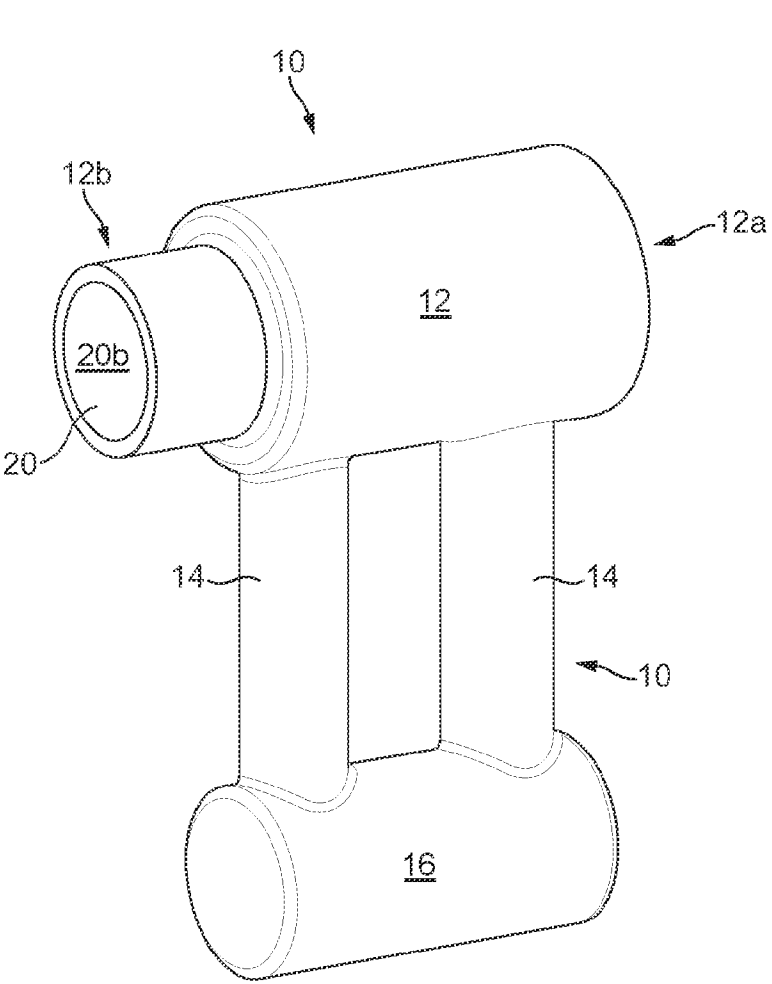
FIG. 2 shows a front end perspective view of an appliance according to the invention.
Figure 1:
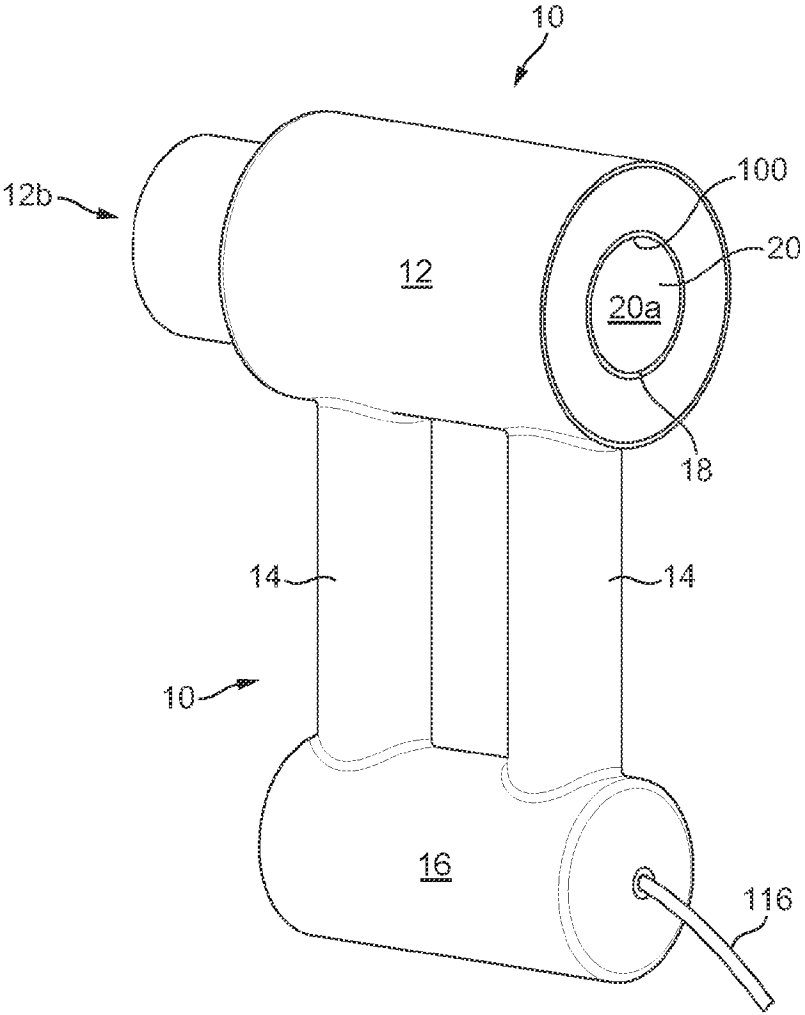
FIG. 1 shows a rear end perspective view of an appliance according to the invention.
Figure 3:
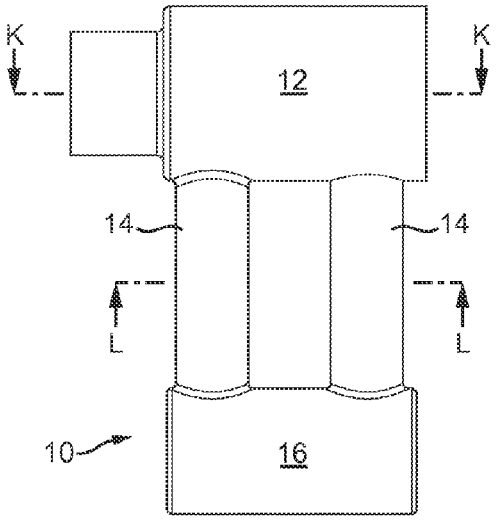
FIG. 3 shows a side view of an appliance according to the invention.
Figure 4:
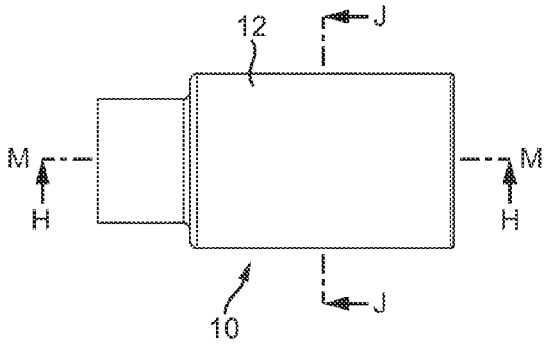
FIG. 4 shows a top view of an appliance according to the invention.
Figure 5A:
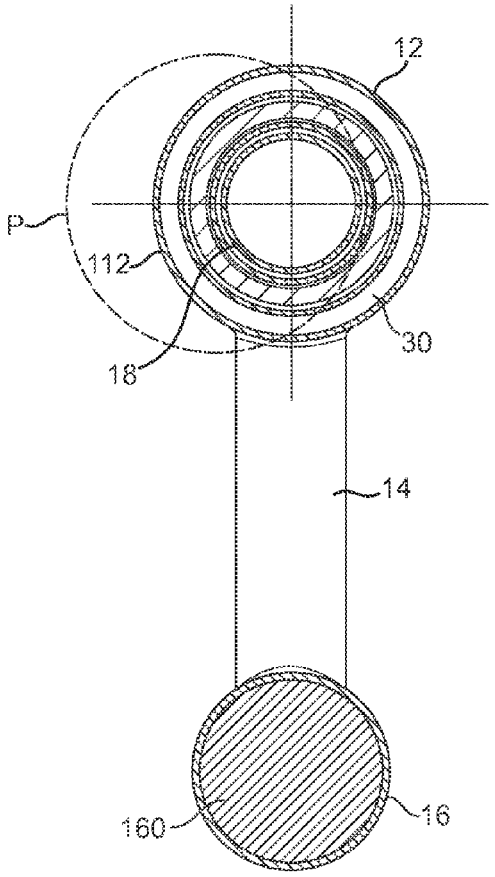
FIGS. 5*a* and 5*b* show sectional views along line J-J of FIG. 4.
Figure 5B:
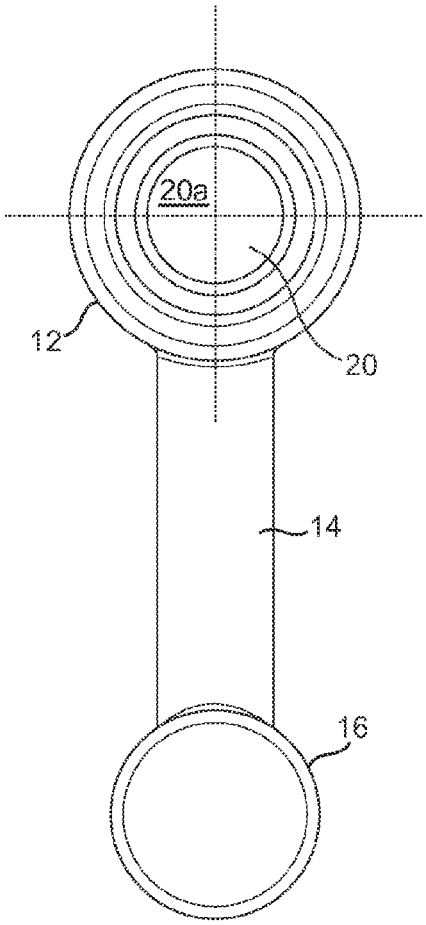
Figure 5C:
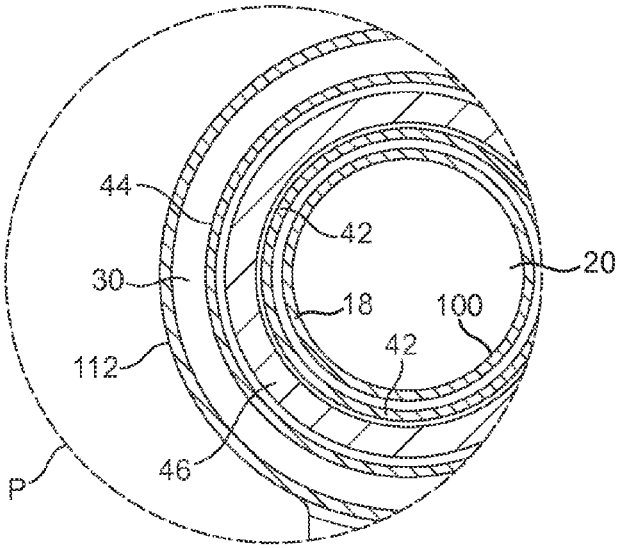
FIG. 5*c* is an enlargement of area P of FIG. 5*a;*

FIGS. 1 to 4 show various views of an appliance 10 having a first body 12 which defines a fluid flow path 20 through the appliance and a pair of ducts 14 which extend from the first body 12 to a second body 16. The fluid flows through the appliance from an inlet or upstream end to an outlet or downstream end.

With reference to FIGS. 5*a*, 5*b*, 5*c* and 6, the fluid flow path 20 has a fluid intake 20*a* at a rear end 12*a* of the body 12 and a fluid outflow 20*b* at a front end 12*b* of the body 12. Thus, fluid can flow along the whole length of the body 12. The fluid flow path 20 is a central flow path for the body 12 and for at least a part of the length of the body 12 the fluid flow path is surrounded and defined by a tubular housing 18. The tubular housing 18 is a bore, pipe or conduit that the generally longer that it is wide and preferably has a substantially circular cross section, however, it may be oval, square, rectangular or another shape. The first body is tubular in shape.

Figure 6:
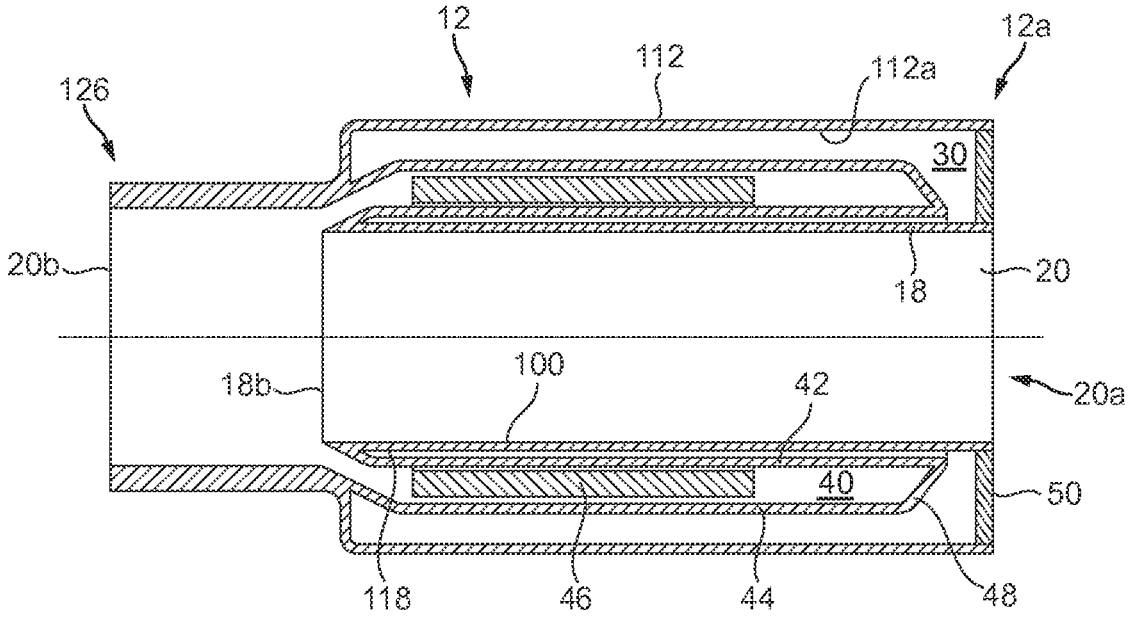
FIG. 6 shows a sectional view along line K-K of FIG. 3.
Figure 9:
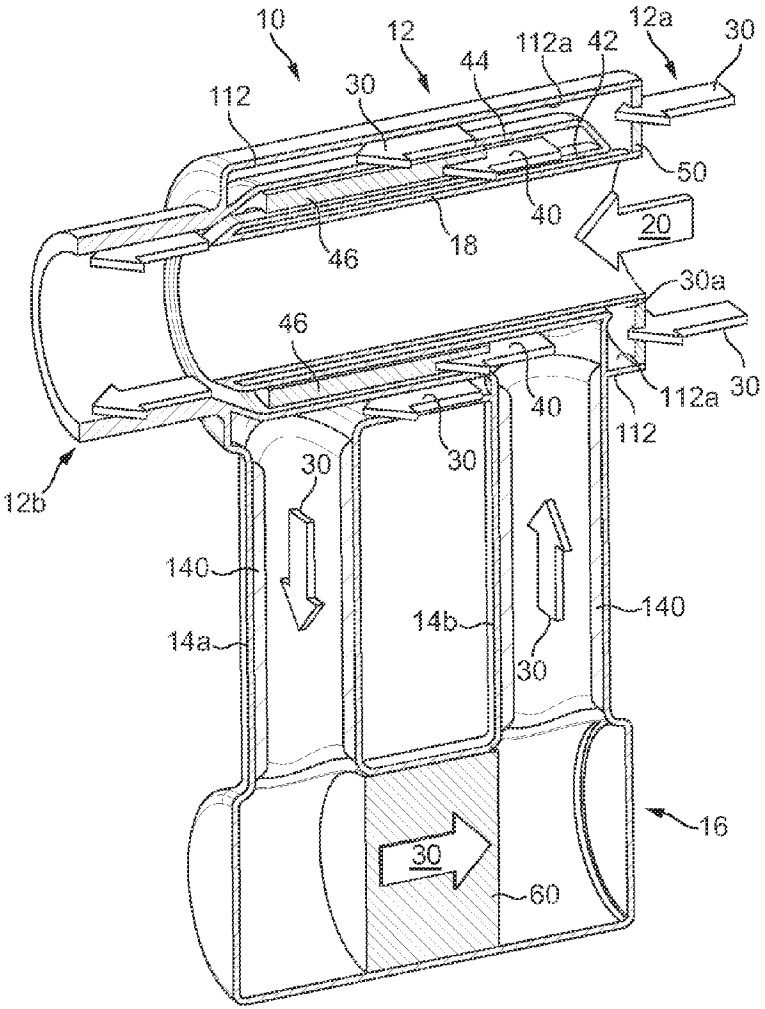
FIG. 9 shows a 3D sectional view along line H-H of FIG. 4.
Figure 8:
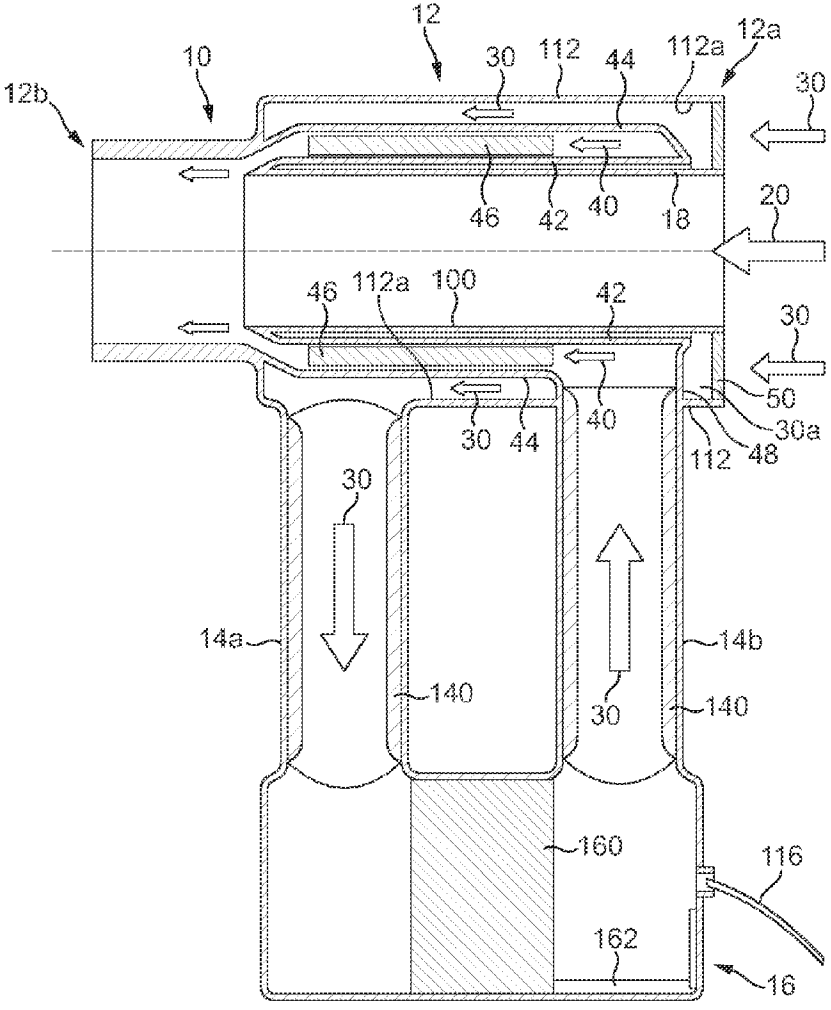
FIG. 8 shows a sectional view along line M-M of FIG. 4.

With reference to FIGS. 6, 8 and 9 in particular, a primary fluid flow path 30 will now be described. The primary fluid flow path 30 is generally annular to the fluid flow path 20 at the fluid intake end 12*a* of the body 12. In this particular embodiment, the primary fluid flow path 30 passes down the first tiered section along the inner skin 112*a* of the outer wall 112 of the body 12 and from there down a duct 14*a* through the second body 16 and up the other duct 14*b* back into the body 12 and into a second tiered section or outlet section of the primary flow path 40. The outlet section of the primary flow path 40 is generally annular to the fluid flow path 20 and is nested between the first tier of the primary fluid flow path and the fluid flow path in the body 12. Thus for at least a portion of the length of the body 12, there is a three tiered flow path 20, 30, 40. The primary fluid flow path 30 has an inlet end, a loop and an outlet end.

There is a single opening at the inlet end 12*a* of the body 12 which is split into a first inlet 20*a* through which fluid enters the fluid flow path 20, and a second fluid inlet 30*a* through which fluid enters the primary fluid flow path 30. In this embodiment, the first inlet and the second fluid inlet are co-planar and are divided into two inlets by the bore 18.

The second tiered section located downstream from the first tiered section and the tiered sections are arranged in series. In this example, fluid flows in substantially the same direction through the tiered sections. The first tiered section is isolated from the second tiered section by inner tubular walls 42 and 44 and an annular wall 48 which connects between the inner walls. Both the first and second tiered sections are annular and the first tiered annular section defined by walls 112*a* and 44 extends about the second annular tiered section defined by walls 44 and 42.

The second body 16 houses a fan unit 160 which includes a fan and motor for driving the fan. Power is supplied to the fan unit 160 via an electric cable 18 and internal electronics 162. The cable 18 is connected to the second body 16 and has a standard household plug (not shown) at its' distal end. Thus, fluid that flows through the primary fluid flow path 30 is drawn in to an inlet section by the action of the fan unit 160. When the primary flow path 30 returns to the body 12, it becomes an outlet section of the primary flow path or second tiered section 40 which flows between two inner tubular walls 42,44 of the body 12 which are located external to tubular housing 18 and internal to the outer wall 112 of the body. Housed within the two inner walls 42,44 of the body in the outlet section of the primary fluid flow path 40 is an at least partially annular heater 46 which can heat the fluid that flows through. Thus the second tier or outlet section of the primary fluid flow path 40 is, in this embodiment the directly heated flow.

The second body 16 is tubular in shape and the longitudinal axes of the first and second bodies are parallel. The fluid flow path 20 extends through the body 12 in an axial direction. An outlet section of the primary fluid flow path 40 extends through the body 12 in an axial direction and surrounds the fluid flow path 20, and a heater 46 located within the section of the primary fluid flow path 40 for heating fluid passing through the primary fluid flow path, and the heater 46 has a length extending in the axial direction.

The tubular housing 18 is also a bore that extends through the body 12; a conduit that extends between the first fluid inlet 20*a* and the first fluid outlet 20*b*; a first external surface of the body 12 that is also an inner surface of body.

The heater 46 is preferably annular and can be of the convention type of heater generally used in hairdryers i.e. comprising a former of a heat resistant material such as mica around which a heating element, for example and nichrome wire, is wound. The former provides a scaffold for the element enabling fluid to pass around and between the element for efficient heating.

When the fan unit is operated, fluid is drawn into the primary fluid flow path 30 at the fluid inlet end 12*a* by the direct action of the fan unit 160. This fluid then flows through an inlet section of the primary fluid flow path along the inside 112*a* of the outer wall 112 of the body 12 down a first duct 14*a*, through the fan unit 160 and returns to an outlet section of the primary fluid flow path 40 of the body 12 via the second duct 14*b*. The outlet section of the primary fluid flow 40 passes around a heater 46 and when the heater is switched on fluid in the outlet section of the primary fluid flow path 40 is heated by the heater 46. Once the fluid in the outlet section of the primary fluid flow path 40 has passed the heater 46 it exits from the front end 12*b* of the body 12 of the appliance.

The fluid flows is a generally circular motion through the primary fluid flow path; the handle means are generally U-shaped i.e. along the body in a first direction down one duct in a second direction along the second body in a third direction and up the second duct in a fourth direction which is the opposite direction to the first duct. The handles are spaced apart When the fan unit 160 is switched on, air is drawn into the intake 30*a* of the primary flow path 30, through the outlet section of the primary fluid flow path 40 and out of the fluid outflow 12*b* of the body 12. The action of this air being drawn in at one end 12*a* of the body and out of the other end 12*b* of the body causes fluid to be entrained or induced to flow along the fluid flow path 20. Thus there is one fluid flow (the primary flow path 30) which is actively drawn in by the fan unit and another fluid flow which is created by the fluidic movement caused by the action of the fan unit 160. This means that the fan unit 160 processes a portion of the fluid that is output from the body 12 and the rest of the fluid that flows through the body through the fluid flow path 20 passes through the body 12 without being processed by the fan unit.

The entrained fluid that passes through the fluid flow path 20 exits from a downstream end 18*b* of the tubular housing and combines with the fluid that exits the outlet section of the primary fluid flow path 40 near the fluid outlet 12*b* of the body 12. Thus the drawn flow is augmented or supplemented by the entrained flow. The second fluid outlet is annular and emits into the fluid flow path so the fluid flow paths merge within the hairdryer.

A filter 50 is provided at the fluid inlet 12*a* of the body 12. This filter 50 is provided to stop foreign objects such as hair and dirt particles from entering at least the primary fluid flow path 30 and travelling along the primary fluid flow path 30 to the fan unit 160 and potentially causing damage to the fan unit and/or reducing the life of the fan unit 160.

The filter 50 is preferably an annular filter that only covers the fluid flow intake of the primary fluid flow path 30, thus only the fluid that flows through the primary fluid flow path 30 is filtered by the filter 50. This has the advantage that the amount of filter material required compared to a conventional appliance is reduced as only approximately half of the cross-sectional area at the fluid intake end 12*a* is filtered—obviously, the exact proportions of filtered and non-filtered flow depend on the relative cross-sections of the fluid flow paths 20, 30 as well as any funneling action due to the design of the fluid intake end of the body 12. Another advantage is that a line of sight is provided through the central or first flow path 20 of the body 12 so a person using the appliance can see through it whilst using the appliance.

In addition, where no filter or an annular filter 50 is provided, the internal surface 100 of the tubular housing is accessible from outside the appliance. In fact, the internal surface 100 of the bore or tubular housing defines a hole (the first flow path 20) through the appliance 10 and the inner surface 100 of the tubular housing is both an inner wall and a first external wall of the appliance 10.

The ducts 14 are used for conveying fluid flow around the appliance. In addition one or both of the ducts 14*a*, 14*b* additionally comprises a handle for a user to hold whilst using the appliance. The duct 14*a*, 14*b* may comprise a grippable portion on at least a part of the duct that acts as a handle to assist a user holding the appliance. The ducts are spaced apart with one duct 14*a* being located near the front end 12*b* of the body 12 and the other duct 14*b* being located near the rear end 12*a* of the body 12.

The use of two body parts separated by a handle means that the appliance can be balanced, in this case by the heater being provided in one part of the body and the fan unit being provided in the second body part so their weights are offset.

Figure 7:
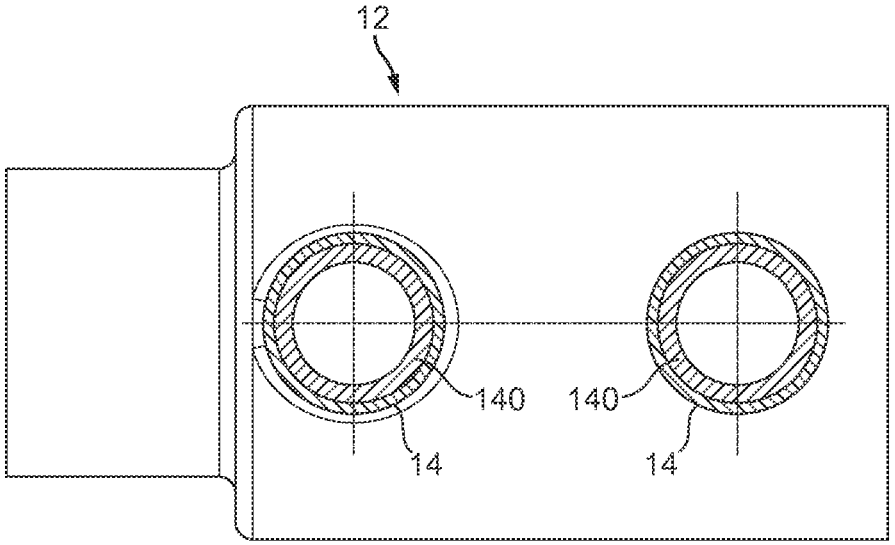
FIG. 7 shows a sectional view along line L-L of FIG. 3.

Referring now to FIG. 7, in this embodiment the ducts 14 are generally circular in cross section and are preferably lined with a material 140. This material 140 is for example a foam or felt for example that is used for one or more of the following: to mitigate noise from the primary fluid flow; vibrations from the fan unit 160; or as an insulator to retain heat within the fluid flow system of the appliance. The absorbing properties of the material will at least mitigate the property is question and may be tuned specifically to an appliance either by material density or lining thickness for example. The material can additionally be chosen based on resonant frequencies of the appliance. The material can additionally be chosen or tuned based on resonant frequencies of the appliance. In this way the appliance can be silenced, or manipulated tonally to improve noise characteristics to a user.

The lining material 140 is preferably flared, rounded or chamfered at one or both of the upstream 140*a* and downstream 140*b* end of the lining. This can reduce pressure losses in the ducts and assist in reducing the noise generated as a less turbulent flow into/out of the lined portion is provided.

Important features of the invention herein described include the fact that the fan unit 160 only processes a portion, preferably around half of the fluid that flows from the fluid outflow 20*b* of the appliance 10 for example, the total fluid flow through the appliance is 23 l/s with around 11 l/s being drawn through the motor. The approximately 50% split of drawn to entrained fluid is not essential and can be less or more; the relative fluid flow rates are a function of losses within the duct pathways for each flow path and the configuration e.g. the diameter and cross-sectional areas of the duct pathways.

The use of a tiered flow path through the body 12 the appliance 10 is also advantageous as one or more of the fluid flow paths can be used to insulate one or more of the walls of the body. The inlet section of the primary fluid flow path and the fluid flow path act as heat sinks or thermal exchangers for the outlet section of the primary fluid flow path i.e. fluid in the centre of the body. It also results in all the fluid flowing through the body being heated whether actively or passively.

The fluid that is processed or drawn in by the fan unit 160 flows through the inlet section of the primary fluid flow path 30 and for a least a part of the flow path through the body, this fluid flows through a duct or conduit that is external to the heater 46 i.e. this primary fluid flow path 30 is between the heater 46 and an outer wall 112 of the body 12 and so provides a moving fluid insulator for the outer wall 112 of the body 12. The fluid flow will extract heat from the walls 42, 44, 112 that form the conduit or duct for the primary fluid flow 30 and therefore be heated as it passes near the heater 46. Once this pre-heated or pre-warmed fluid is drawn through the fan it exits the duct 14*b* into an outlet section of the primary fluid flow path or heated flow path 40. Thus, the fluid insulator is subsequently heated by the heater 46 so less heat energy is lost by the system to ambient. Heat that may have been lost to the outer body 112 is recovered thus a higher percentage of the heat energy input to the system remains in the primary or second tier 40 of the flow.

Figure 10:
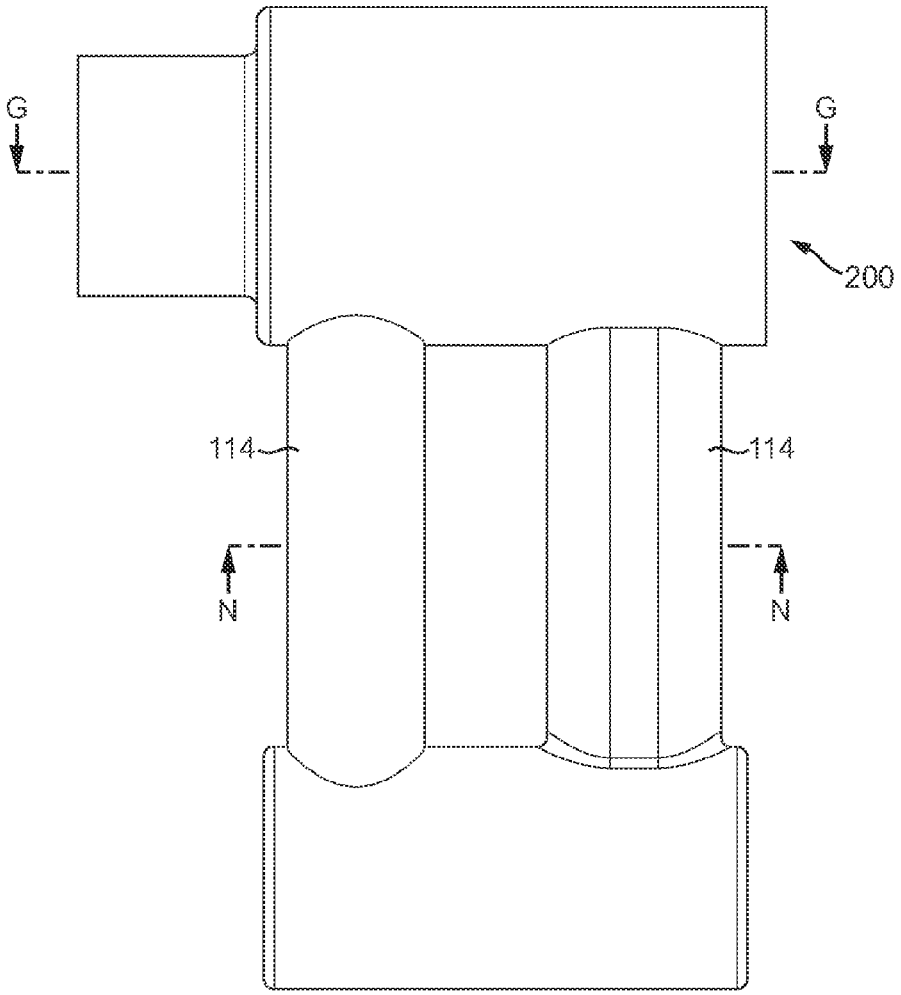
FIG. 10 shows a side view of a second appliance according to the invention.
Figure 11:
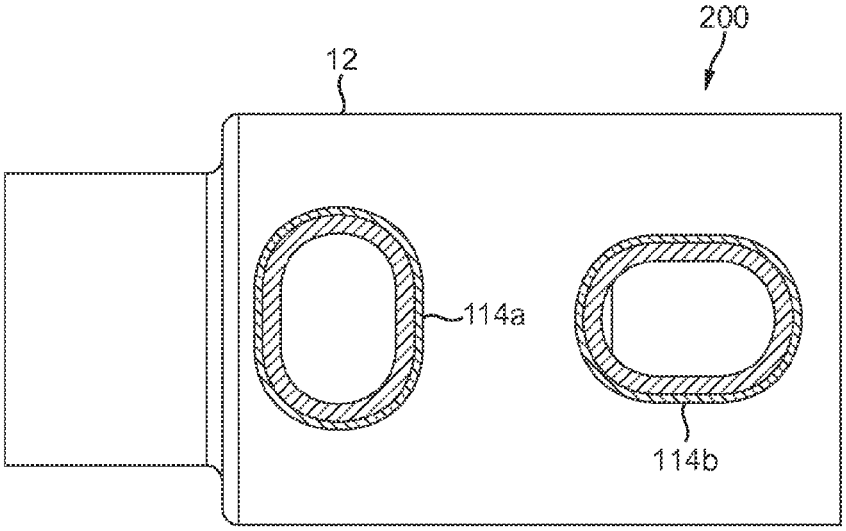
FIG. 11 shows a sectional view along line N-N of FIG. 10.

A second embodiment is described with respect to FIGS. 10 and 11. In this embodiment, the appliance 200 has ducts 114 which are oval in cross-section and extend parallel to each other. There are advantages to using oval instead of circular ducts, the first is that when the duct is used as a handle it can be easier for a user to grip as the oval shape mimics the shape made by curled figures more precisely than a circular grip, the second is that the oval shape can be used to impart directionality to the ducts or handles. This feature is shown in FIG. 11 where a first duct/handle 114*a* is oriented at right angles to a second duct/handle 114*b*. This directionality can make the appliance easier to use.

A third advantage is that for a grippable handle, the oval shape gives a larger cross-sectional area than the circular handle meaning that a greater flow of fluid can pass through the oval handle. This can reduce one or more of the noise produced by the appliance in operation, power consumed by the appliance and pressure or duct losses within the appliance.

Figure 12:
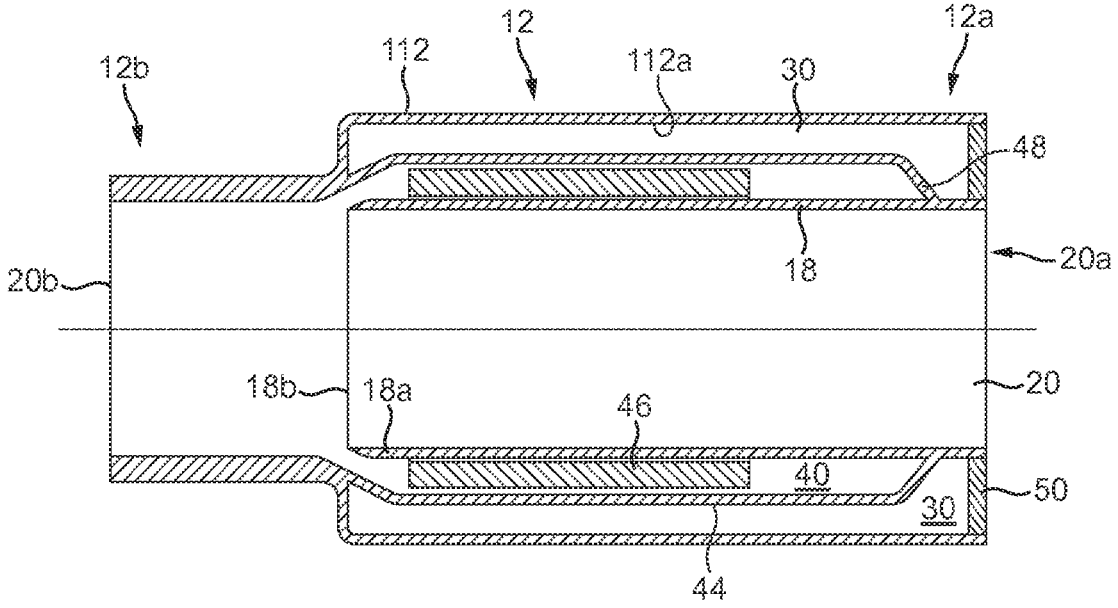
FIG. 12 shows a sectional view through the body of an appliance according to the invention.

Various arrangements of ducting within the body 12 are possible, some of which will now be described. Referring to FIG. 12, the heater 46 is supported directly on the outer surface 18*a* of tubular housing 18 which is a single walled housing. The fluid that flows through the fluid flow path 20 along the inside of the tubular housing 18 provides a cooling action and will be heated slightly as it extracts heat from the housing 18. In addition, fluid that flows along the inlet section of the primary flow path 30 will also extract heat from inner wall 44 that separates the inlet section of the primary fluid flow path 30 from the heated outlet section of the primary fluid flow path 40 and isolates the inlet and outlet sections of the primary fluid flow path. Thus, the fluid that is processed or drawn in by the fan unit is pre-warmed or heated passively prior to being heated directly and provides a cooling flow for the second external or outer wall 112 of the body 12 of the appliance.

FIG. 6 shows an alternative configuration having a ducted inner wall coolant path 118 between the tubular housing 18 and inner wall 42 of the outlet section of the primary fluid flow path 40 producing a third section of the primary fluid flow path which is parallel to the outlet section of the primary fluid flow path and surrounded by the outlet section of the primary fluid flow path which contains heater 46. This ducted inner wall coolant path 118 is a closed path i.e. it does not vent out. Some of the fluid which is drawn into the primary fluid flow path 30 will pass along the ducted inner wall 118 and provide a layer of fluid insulation between the heater 46 and the outer wall of the tubular housing 18. A combination of conduction and convection through the fluid in the ducted inner wall coolant path 118 provides a cooling effect for the tubular housing 18. The third section of the primary fluid flow path is annular and the second annular section extends about the third section and is in parallel with the third section.

Figure 13:
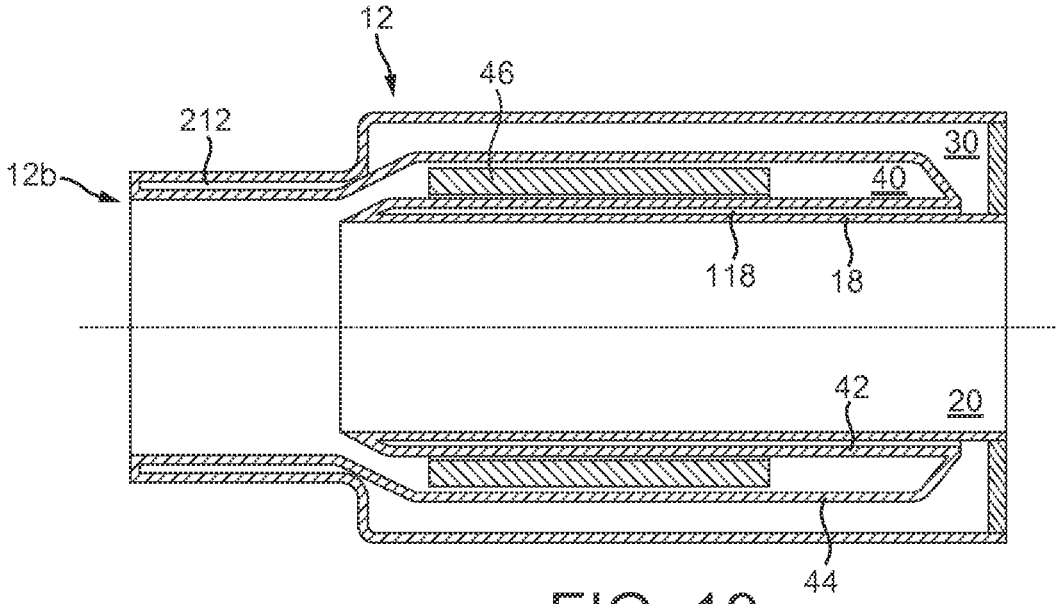
FIG. 13 shows a sectional view through the body of a further appliance according to the invention.

FIG. 13 shows an arrangement having a ducted outer wall cooling path 212 providing a third section of the primary fluid flow path in parallel with the outlet section of the primary fluid flow path in combination with a closed ducted inner wall coolant path 118. In the embodiments described so far, fluid that is drawn into the body 12 flows down the ducts and back through an outlet section of the primary fluid flow path before joining entrained fluid. As a result, a portion of the body 12 near the outflow end 12*b* will be in direct contact with the heated fluid and may become hot. To mitigate this heating effect a ducted outer wall cooling path 212 is provided which enables fluid that is drawn into the primary fluid flow path 30 to continue within a double walled body to near the outflow end 12*b* of the body 12. In this example this outer wall cooling path 212 is closed so provides a cooling effect by a combination of conduction and convection through the fluid in the duct.

Figure 14:
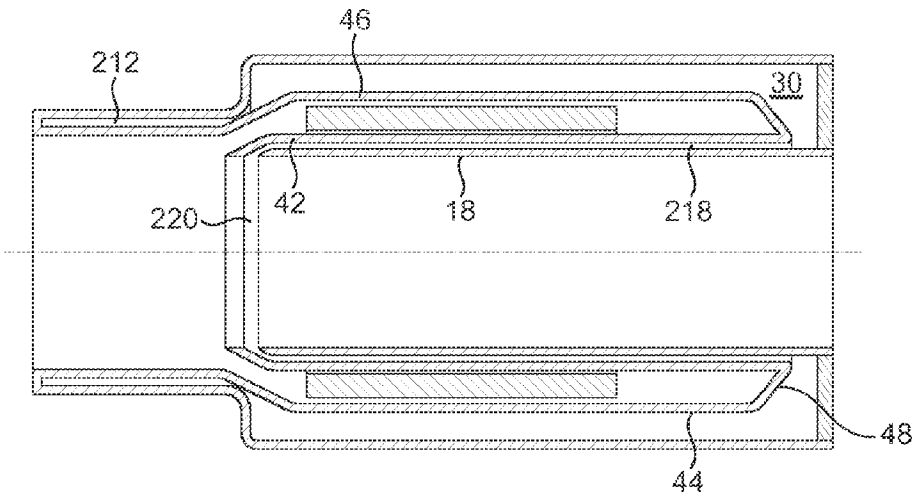
FIG. 14 shows a sectional view through the body of another appliance according to the invention.

FIG. 14 shows an alternative arrangement having a ducted outer wall cooling path 212 in combination with an open or vented ducted inner wall coolant path 218 between the tubular housing 18 and inner wall 42 of the outlet section of the primary fluid flow path 40. This ducted inner wall coolant path 218 again is located within the primary fluid flow path 30 so some of the drawn in fluid will pass along the duct, however at the distal end, the duct vents 220 into the entrained air stream the flows through the fluid flow path 20. This combined vented and entrained fluid then combines with the drawn fluid for exit at the outflow of the body 12. As there is a constant fluid flow through this cooling duct 218 in use, it provides a constant replenishment of fluid for heat exchange with inner wall 42.

Figure 15:
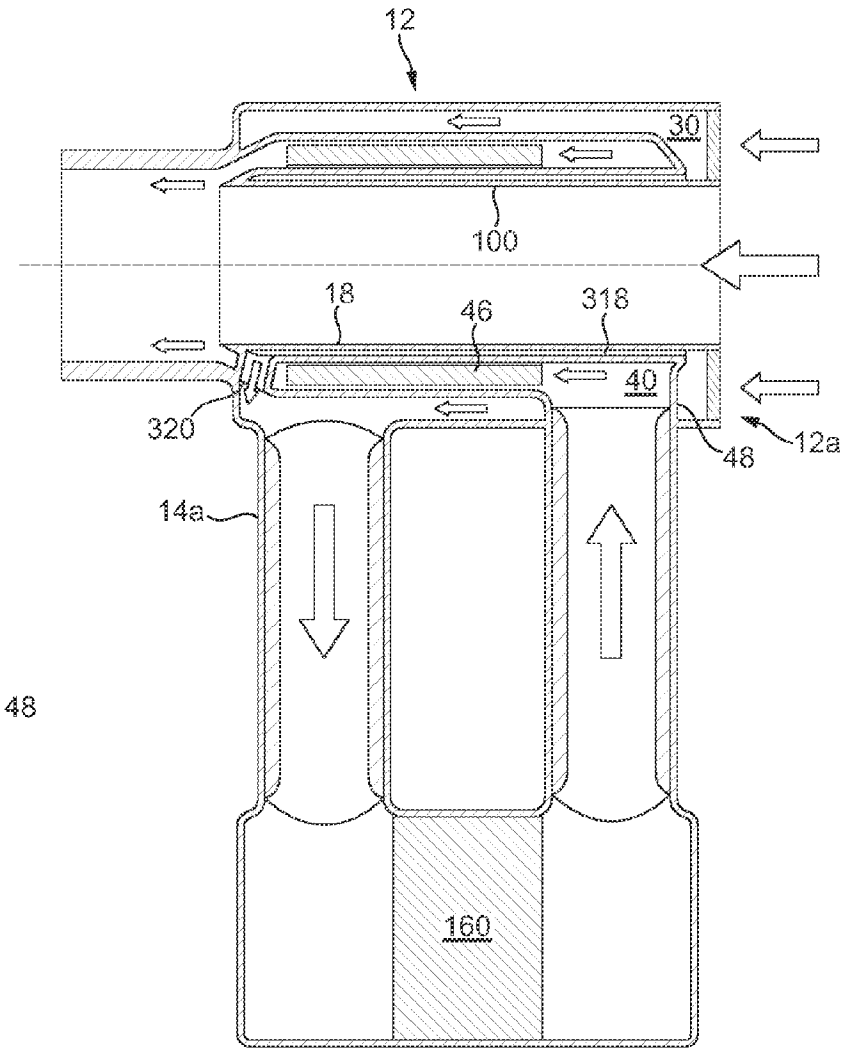
FIG. 15 shows a sectional view through the body of yet another appliance according to the invention.

FIG. 15 shows an alternative arrangement having a ducted inner wall coolant path 318 which enables some of the drawn in fluid to flow along the radially inner side of the heater 46, between the heater 46 and the tubular housing 18, before being ducted 320 into the drawn in flow path 30 at duct 14*a*. This has the advantage that the ducting and inner wall arrangements not only provide cooling for the outer body of the appliance but also for the inner wall which is accessible from the fluid inlet end 12*a*. Thus all the fluid that is used to provide cooling for the heater is subsequently drawn through the fan unit 160 and into the outlet section of the primary fluid flow path 40 to be heated by heater 46.

Figure 17:
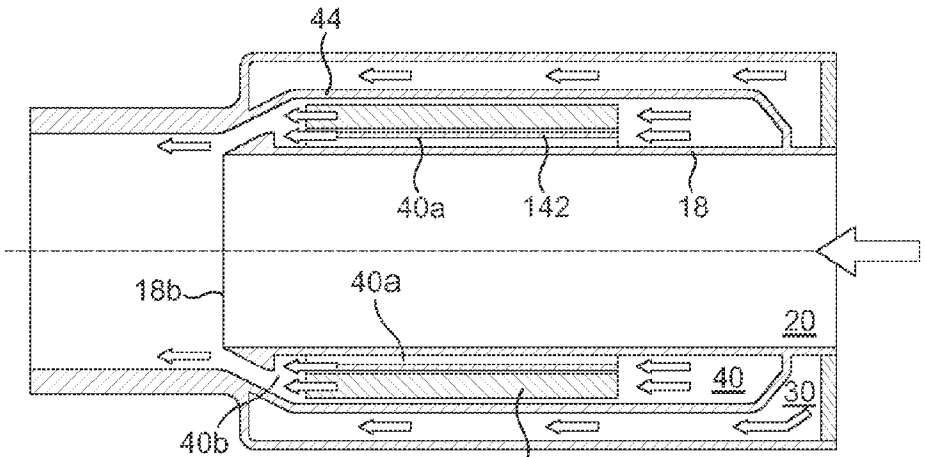
FIG. 17 shows an alternative sectional view through the body of the appliance of FIG. 16.
Figure 16:
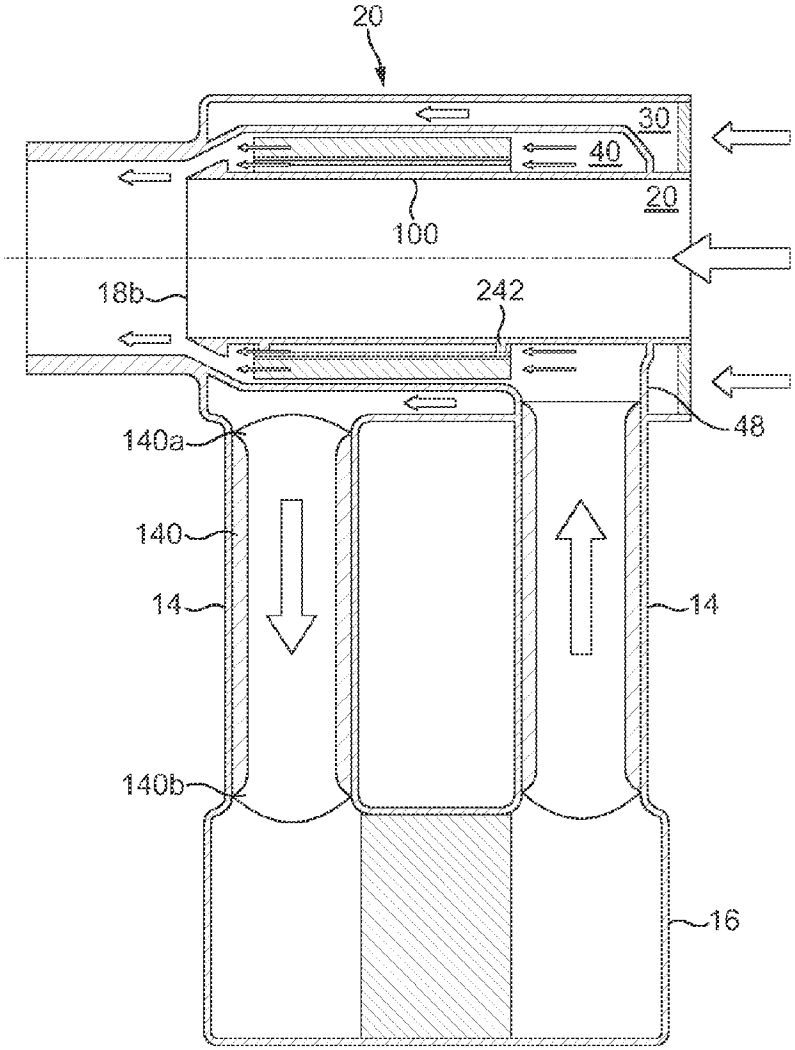
FIG. 16 shows sectional view through the body of an appliance according to the invention.

FIGS. 16 and 17 show an appliance with an alternate internal ducting arrangement. In this embodiment, the heater 46 is spaced apart from the walls 44, 18 that define the outlet section of the primary fluid flow path 40 to provide a fluid flow around as well as through the heater. An inner wall or support 142 is provided spaced from tubular housing 18 by a spacer 242 thus, fluid entering the third or heated flow path 40 can pass through the heater 46, around the outer edges of the heater between the heater and inner wall or support 44 which separates the inlet section of the primary fluid flow path 30 and the outlet section of the primary fluid flow path 40 fluid flow paths and in a flow path 40*a* created between the heater 46 and the tubular housing 18 by the wall 142. At the downstream end of the heater, wall 142 ends allows the two fluid flow paths 40 and 40*a* to recombine 40*b* prior to the fluid flow paths combining at the downstream end 18*b* of the tubular housing 18.

By having the air gap between the heater 46 and the tubular housing 18 which is defined by inner wall 142, the tubular housing is not directly heated by the heater thus, the inner surface of the tubular wall remains relatively cool. In addition, a cooling effect is provided to the tubular housing 18 by entrained fluid that passes through the fluid flow path 20 which is defined by the tubular housing 18 as the fluid extracts heat from the tubular housing. The wall 142 need not be a solid wall, and may include slots or perforations which enables fluid to flow between the two fluid flow paths 40 and 40*a*.

Figure 19:
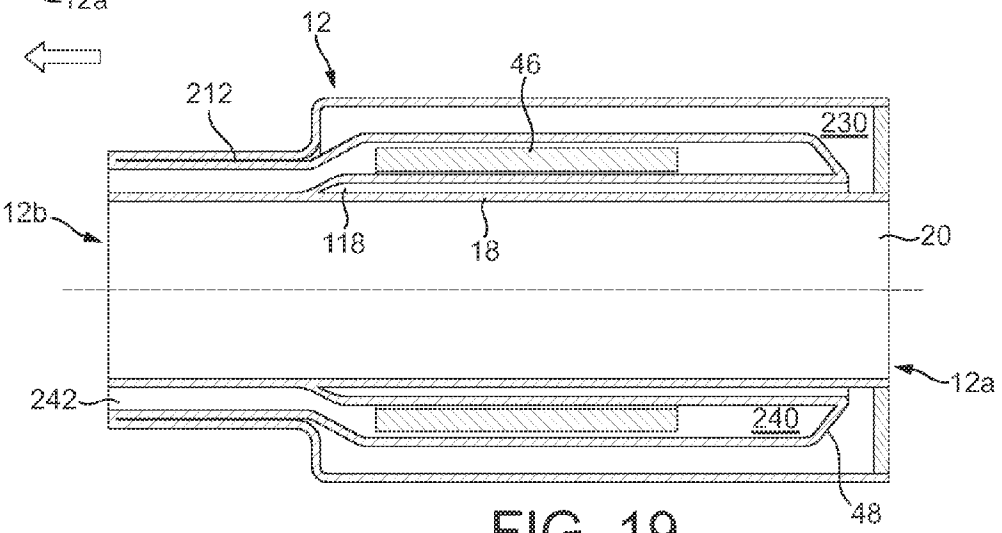
FIG. 19 shows an alternative sectional view through the body of the appliance of FIG. 18.
Figure 18:
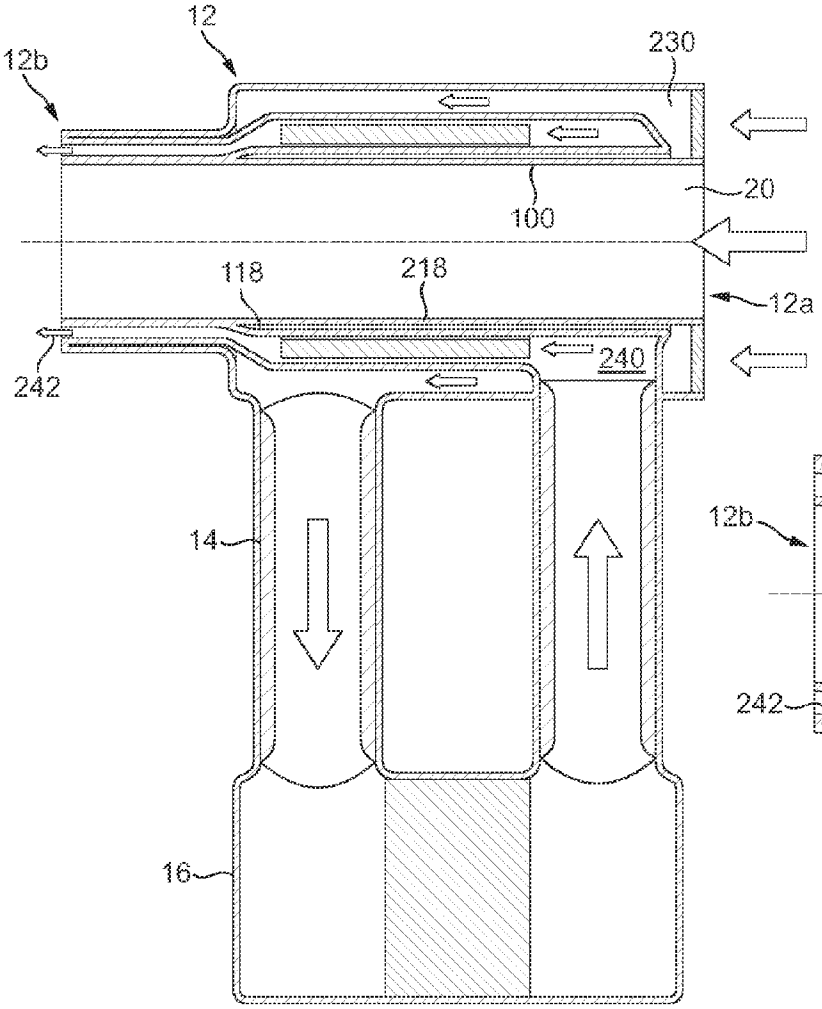
FIG. 18 shows sectional view through the body of an appliance according to the invention.

FIGS. 18 and 19 show an appliance where the entrained and drawn fluids do not combine prior to exiting the body 12 at the outlet end 12*b*.

The inner ducting of the outlet section of the primary fluid flow path 240 may be any one of those described with respect to other embodiments of the invention. In this example, the outlet section of the primary fluid flow path 240 is similar to that described with respect to FIG. 6 i.e. a configuration having a ducted inner wall coolant path 118 between the tubular housing 18 and inner wall 42 of the outlet section of the primary fluid flow path 240 which contains heater 46. This ducted inner wall coolant path 118 is a closed path i.e. it does not vent out. Some of the fluid which is drawn into the primary fluid flow path 30 will pass along the ducted inner wall 118 and provide a layer of fluid insulation between the heater 46 and the outer wall of the tubular housing 218.

The bore or tubular housing 218 begins as in the other examples herein described at the inlet end 12*a* of the body 12. However, the tubular housing 218 continues for the whole length of the body 12 to the outlet end 12*b* of the body. In this manner an annular outflow 242 of the outlet section of the primary fluid flow path or heated fluid flow path 240 is provided at the outlet end 12*b* of the body. The annular outflow 242 extends about the outlet of the fluid flow path. Thus, the entrained and drawn in fluids do not combine within the body of the appliance they combine at the outflow or downstream exit of the appliance. This provides a high velocity jet or free jet of heated fluid at the outflow which is annular and surrounds the entrained and only partially heated flow which exits from the fluid flow path 20.

The primary fluid flow path 230 is as described with respect to other examples and has a ducted outer wall cooling path 212 to provide cooling to the outer surface of the body 12 towards the outflow end 12*b* of the body.

Figure 20:
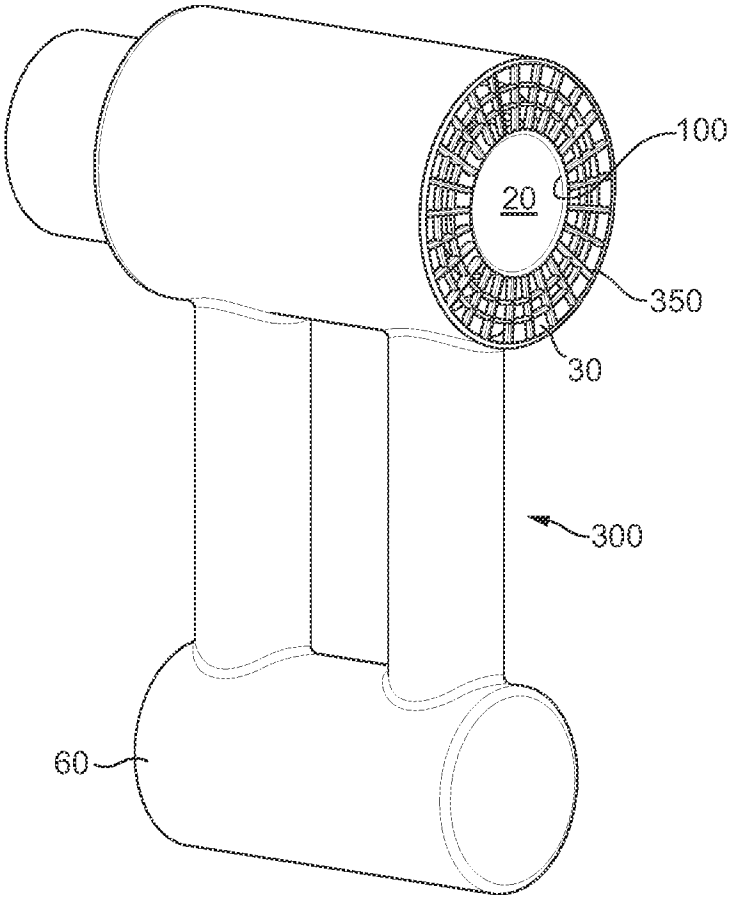
FIG. 20 shows a rear end perspective of a further appliance according to the invention.

FIG. 20 shows an appliance 300 having a filter 350 which is a grill like filter which covers the primary fluid flow path 30, leaving the majority if not all of the central fluid flow path (the fluid flow path) 20 open and unfiltered. The filter 350 may additionally comprise a mesh of material which is disposed between the grills of the filter.

Figure 21:
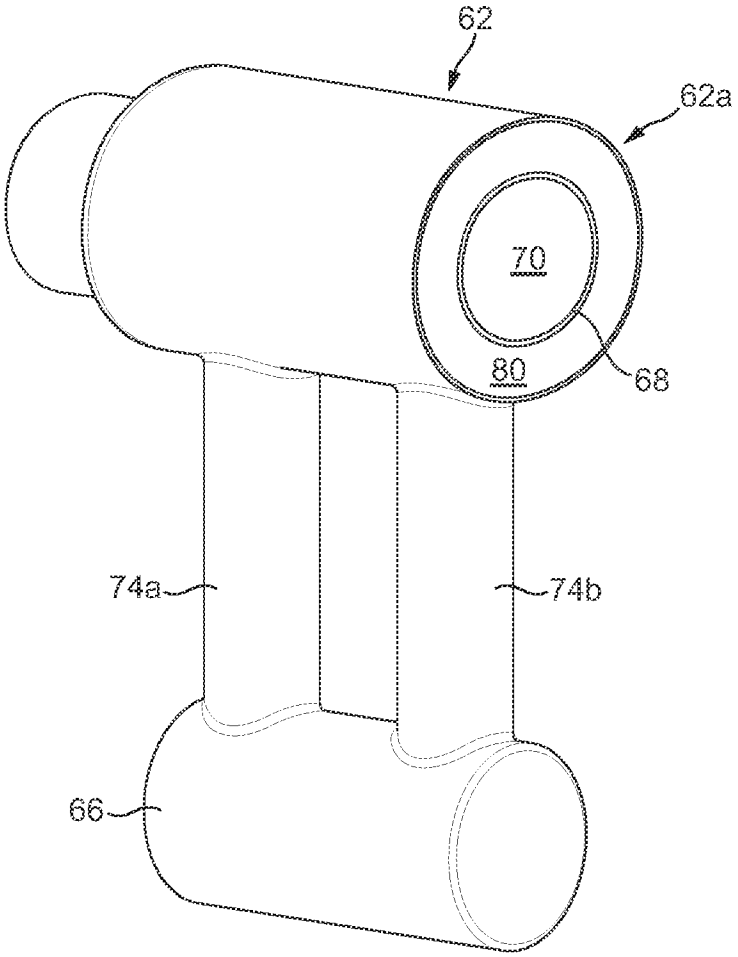
FIG. 21 shows a rear end perspective of an alternative appliance according to the invention.
Figure 22B:
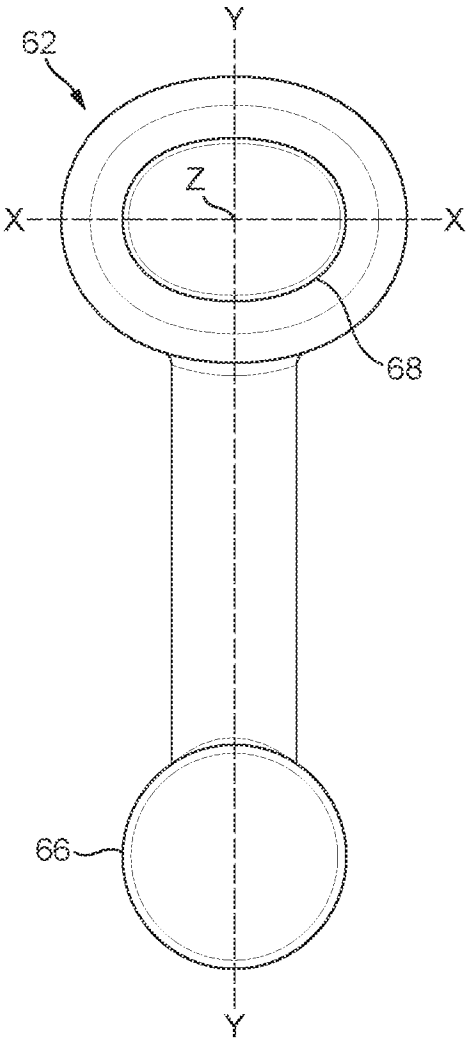
FIGS. 22*a* and 22*b* show rear end views of the appliance shown in FIG. 21.
Figure 22A:
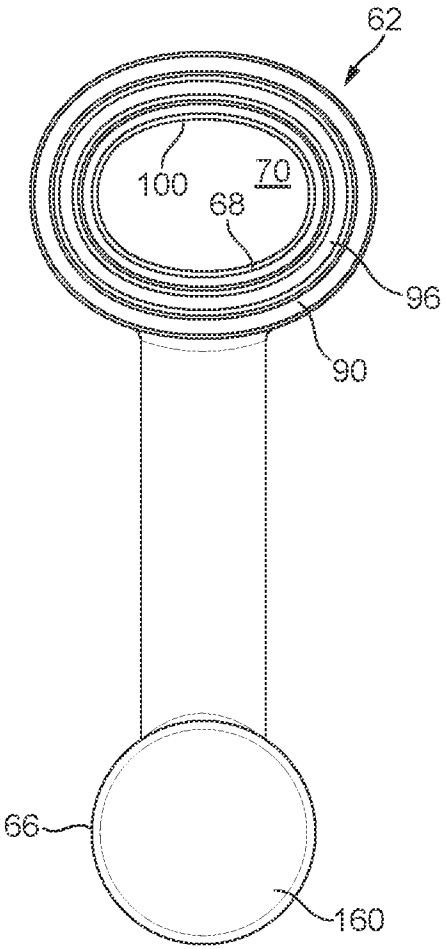

FIGS. 21, 22*a* and 22*b* show an appliance having an oval shaped body 62. The fluid flow path 70 is defined by a tubular housing having an oval cross section 68. An annular and oval shaped primary fluid flow path 80 surrounds the fluid flow path 70 at the inlet end 62*a* of the body 62. Fluid is drawn into the primary fluid flow path 80, down first duct 74*a* into a second body 66 by the action of a fan unit 160 located in the second body 66 as has been previously described. The fluid then flows through the second duct 74*b* to an outlet section of the primary fluid flow path 90. This outlet section of the primary fluid flow path 90 is also oval in cross section and contains an oval heater 96.

In this example the major and minor axes X-X and Y-Y respectively of the first, second and outlet section of the primary fluid flow path all have the same centre Z i.e. are concentric however, this is not essential. In addition, the second body 66 is shown as being generally circular but it may match the external shape of the first body 62. The ducts 74*a* and 74*b* are shown as being generally circular but may be oval and one or both of the ducts 74*a*, 74*b* may comprise handles that are capable of being gripped by a user of the appliance.

Figure 24B:
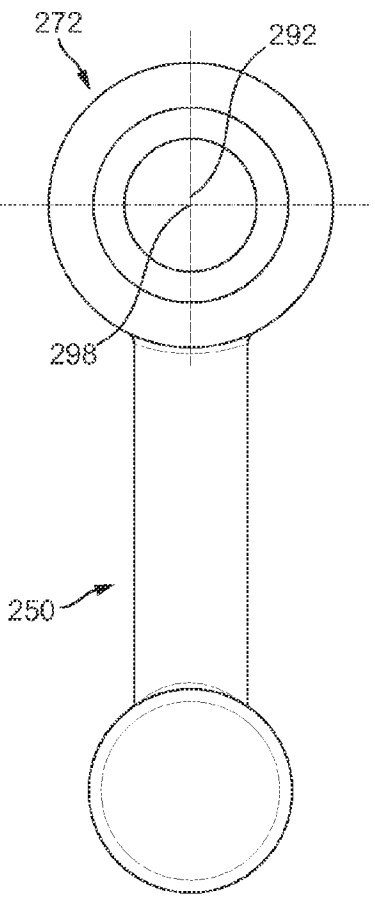
FIGS. 24*a* and 24*b* show rear end views of the appliance shown in FIG. 23.
Figure 24A:
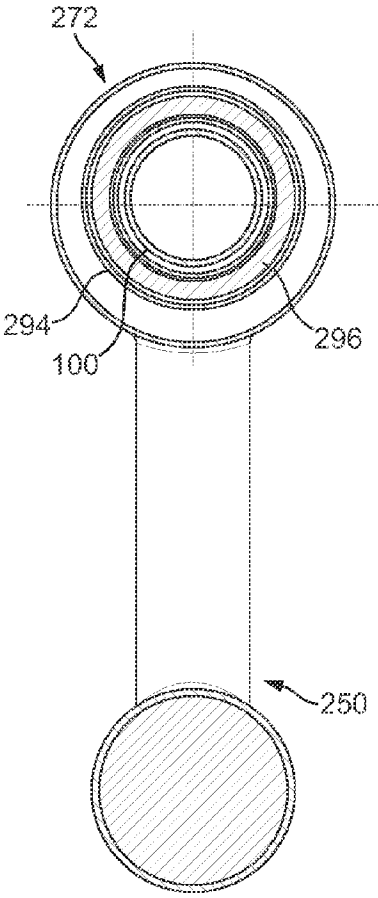
Figure 23:
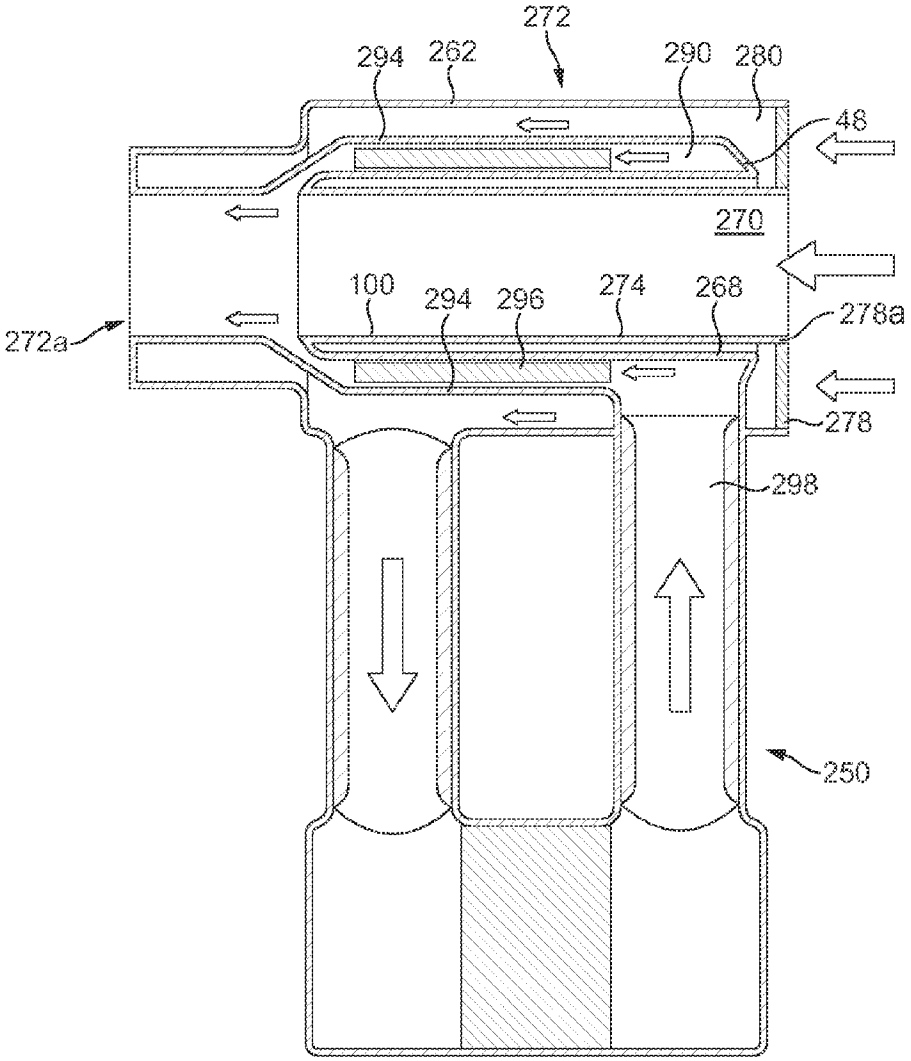
FIG. 23 shows a cross section through another appliance.

FIGS. 23, 24*a* and 24*b* show an appliance 250 having substantially circular flow paths which are non-concentric.

The first 270 and third 290 fluid flow paths are concentric i.e. have a common centre 292 within the body 272 of the appliance. Thus, the heater 296 is also substantially concentric within the outlet section of the primary fluid flow path 290 and this has the advantage that fluid is heated evenly around the cross section of the outlet section of the primary fluid flow path so there are no hot spots in the fluid the exits the body at the outflow end 272*a* of the body 272. The first 270 fluid flow path is defined by tubular housing 274 and the first 270 and third 290 fluid flow paths are enclosed within inner wall or duct 294. This inner wall 294 is offset with respect to the outer wall 262 of the body 272 so is non-concentric to the outer wall 262 of the body 272.

The outer wall 262 has a centre 298 which is therefore offset from the centre 292 of the inner wall 294 and features of the appliance including 270, 274, 294, 290 and 296. A filter 278 is provided at the fluid inlet of the primary fluid flow path 280 and so is a ring shaped filter with a substantially constant outer diameter defined by outer wall 262 of the body 272. The inner diameter varies around the ring as the inner surface of the filer 278*a* is defined by the tubular housing 274.

Alternatively, an inner wall 268, 294 is non-concentric to the external wall 262 for only part of the flow path. For example, the middle or third flow path 290 is defined by walls 294, 268 which are non-concentric to the tubular housing 274, heater 296 and external wall 262 in the region where the primary flow path passes 280 into the third flow path 290. In other words, the walls 268, 294 which define the third flow path 290 where duct flow 298 enters the third flow path 290 are non-concentric to improve the aerodynamics of fluid flow where the direction of the fluid flow changes. The skilled person will appreciate that a number of different configurations are possible.

Figure 25:
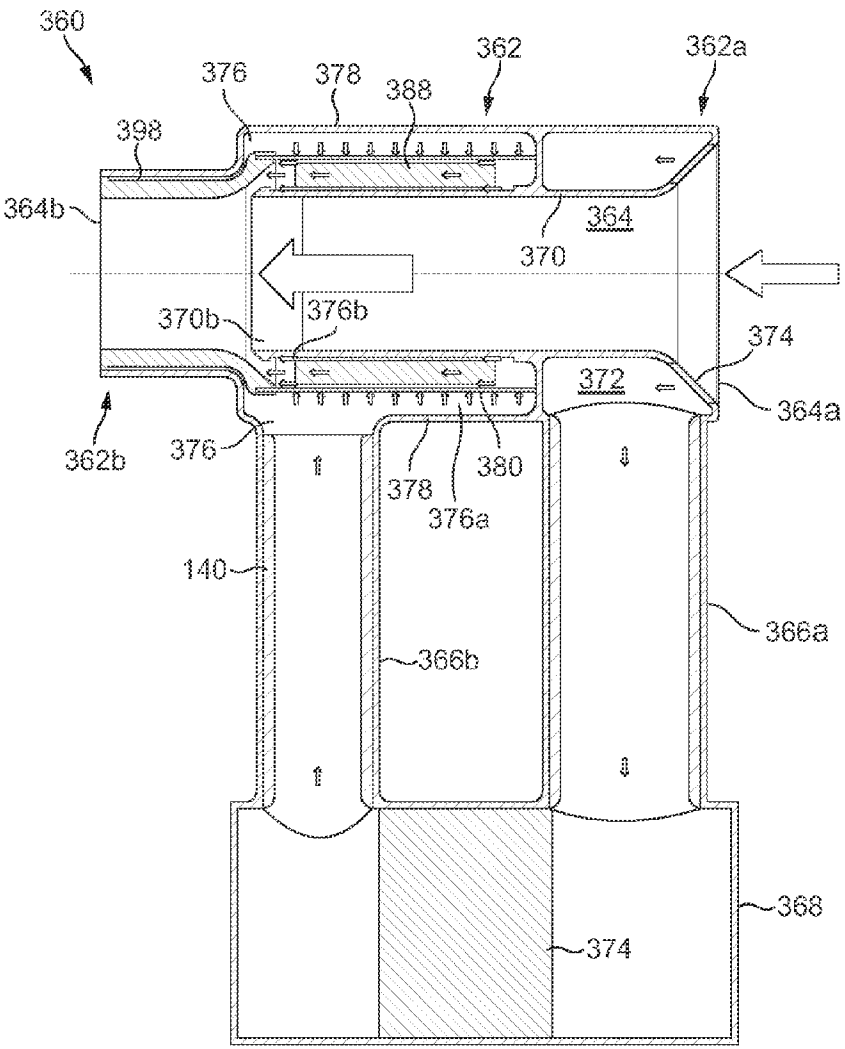
FIG. 25 shows a cross section through an appliance.

FIG. 25 shows an appliance 360 having a having a first body 362 which defines a fluid flow path 364 through the appliance and a pair of ducts 366 which extend from the first body 362 to a second body 368. The fluid flows through the appliance from an inlet or upstream end 362*a* to an outlet or downstream end 362*b*.

The fluid flow path 364 has a fluid intake 364*a* at a rear end 362*a* of the body 362 and a fluid outlet 364*b* at a front end 362*b* if the body 362. The fluid flow path 364 is a central flow path of the body 362 and is surrounded and defined by a generally tubular housing 370.

A primary fluid flow path 372 is provided at the fluid inlet end 362*a* of the body and is generally annular to the fluid flow path 364. A filter 374 is provided to filter fluid that flows into the primary fluid flow path 372. The primary fluid flow path 372 passes into the first body 362 then through a first duct 366*a* to the second body 368 and up the other duct 366*b* back into the body 362. In this embodiment, the first duct 366*a* of the primary fluid flow path 372 is that nearest the fluid intake end 362*a* of the body. The flow path through the ducts is thus the reverse of previous examples.

The second body 368 houses a fan unit 74 and fluid is drawn into the primary fluid flow path by the action of the fan unit. This induces or entrains fluid into the fluid flow path 364.

When the primary fluid flow path 372 returns to the first body 362 a fluid chamber 376 is provided. The outer wall 378 of the chamber is a part of an outer wall of the first body 362. Radially inward of the outer wall 378 is a perforated inner wall 380 which provides fluid communication to a heater 382. After flowing through the heater 382, heated fluid combines with the entrained fluid of the fluid flow path 364 at an upstream end 370*b* of the tubular housing 370.

The flow path from the chamber to mixing of the heated fluid can be considered to be an inlet section of the primary fluid flow path and thus for a portion of the length of the body 362, a three tiered flow path is provided. Fluid in the chamber 376 cools the outer wall 378 and is pre-heated by heat radiating from the inner perforated wall 380. Thus, the chamber provides a thermally insulating barrier between the heater 382 and the external wall 362. The chamber 376 extends about a periphery of the heater 382.

Figure 26:
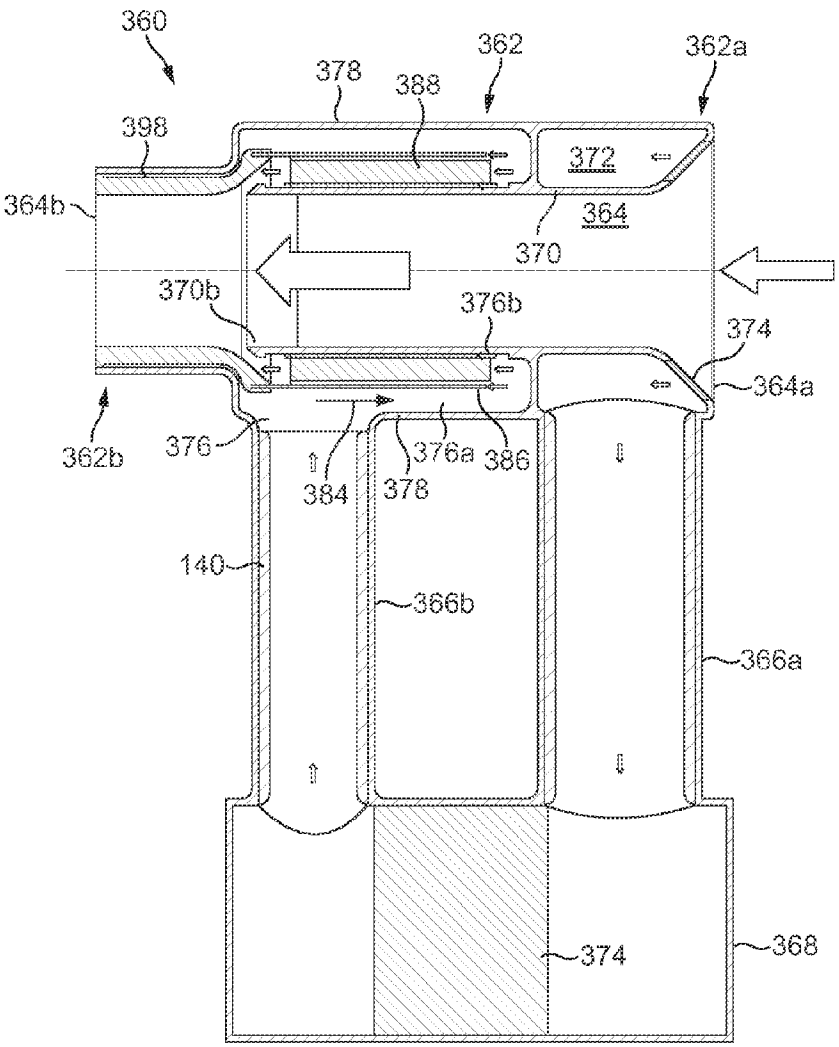
FIG. 26 shows a cross section through another appliance.

An alternative arrangement of the primary fluid flow path is shown in FIG. 26. In this arrangement, the chamber 376 is provided with a solid inner wall 386 that forces fluid to flow along a part of the first body 362 in the reverse direction or the direction opposite 384 to that of the entrained fluid of the fluid flow path 364. The primary fluid flow path is zigzagged. The reverse direction 384 of the flow path is turned to flow towards the outlet end 362*b* of the body, flows through the heater 388 and joins entrained fluid at the end 370*b* of the tubular housing 370. The fluid from the chamber 376 thus encounters the heater somewhere in the middle of the length of the first body 362.

Figure 27:
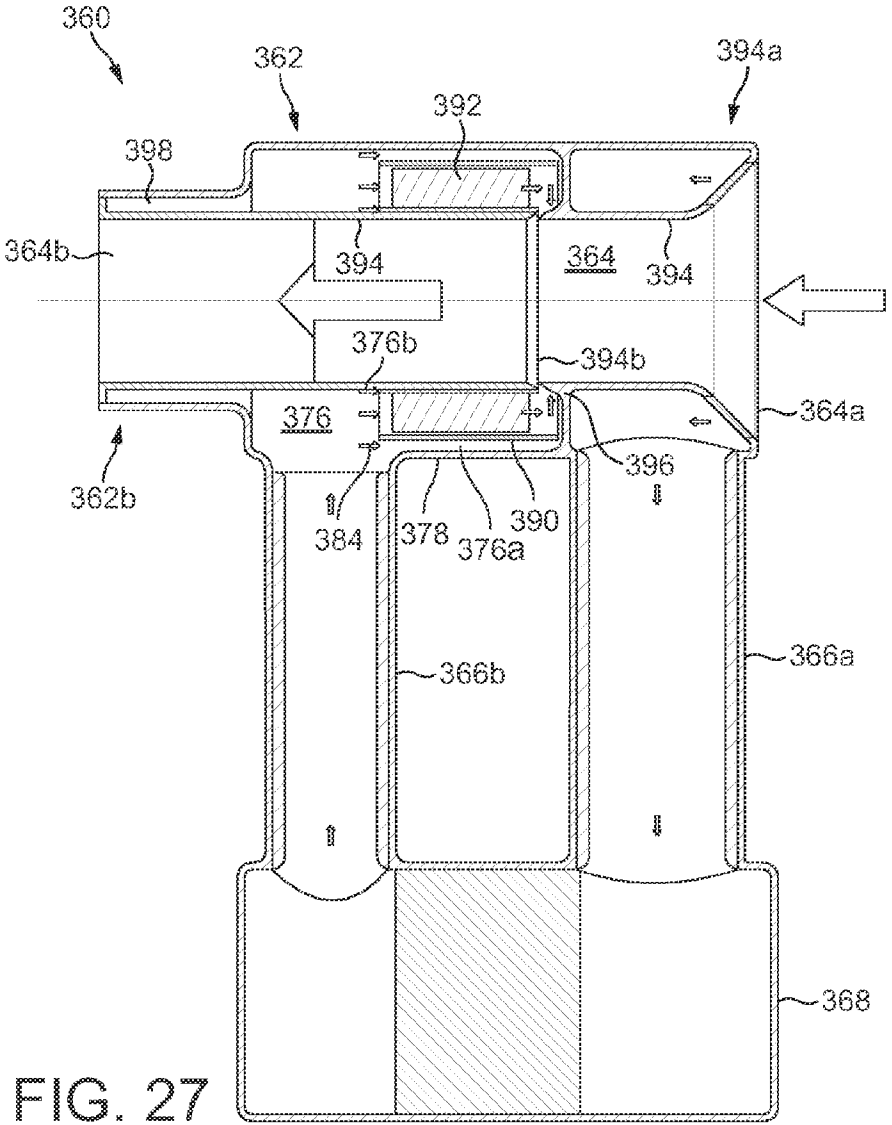
FIG. 27 shows a cross section through another appliance.

In FIG. 27, another arrangement is shown where the combining of the heated and entrained fluid flows occurs in the middle of the first body 362 rather than near or at the downstream end 362*b*. The chamber is provided with a solid inner wall 390 and fluid flows from the second duct 366*b* into the chamber 376 and then along a part of the first body 362 in the reverse direction 384 to that of the entrained fluid of the fluid flow path 364. The heater 392 is provided within this reverse flow section. Once fluid has been heated by the heater 392 it is turned by internal ducting 396 to face the downstream end 362*b* of the body and joins the entrained fluid of the fluid flow path 364 at the downstream end 394*b* of an inlet section of the tubular housing 394.

In these embodiments, the chamber 376 comprises two parallel sections, and a first one of the parallel sections extends through the fluid chamber 378*a* and a second one of the parallel sections extends through the heater 378*b*.

In this embodiment, the tubular housing 394 that defines the fluid flow path is split into two sections 394, 394*a*. A gap between the two sections 394, 394*a* enables the heated fluid to mixing with the entrained fluid flow at the downstream end 394*b* of the inlet section of the tubular housing 394. Thus, mixing of the two fluid flow paths occurs around the downstream end of the heater 392 or the middle of the first body 262. Once the two fluid flow paths have mixed, the second section 394*a* of the tubular housing guides the fluid flow to the outlet end 362*b* of the body 362.

The embodiments of FIGS. 25 to 27 all include a ducted outer wall cooling path 398 which enables some of the fluid that is drawn into the chamber 376 to flow within a double walled body to or near to the outflow end 362*b* of the body 362. This provides a cooling effect by a combination of conduction and convection through the fluid in the duct 398. Thus, the chamber in effect extends about the first fluid outlet 364*b* via the ducted outer wall cooling path 398.

Figure 29:
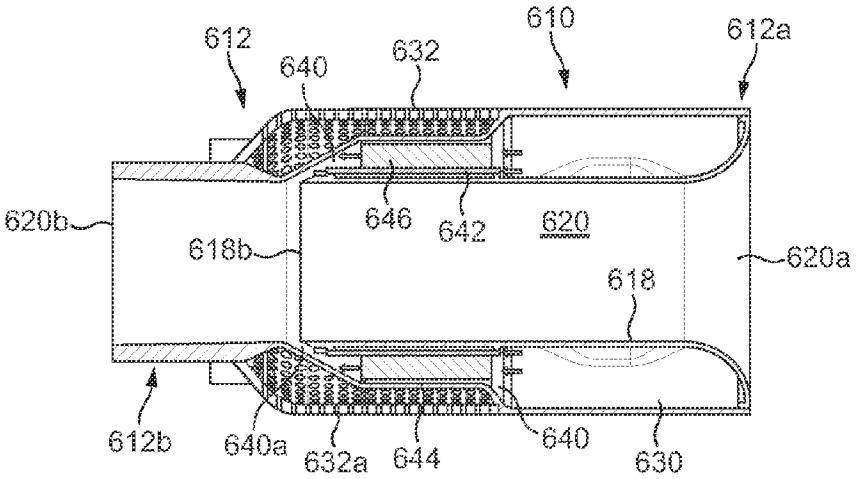
FIG. 29 shows a sectional view across line T-T of FIG. 28.
Figure 28:
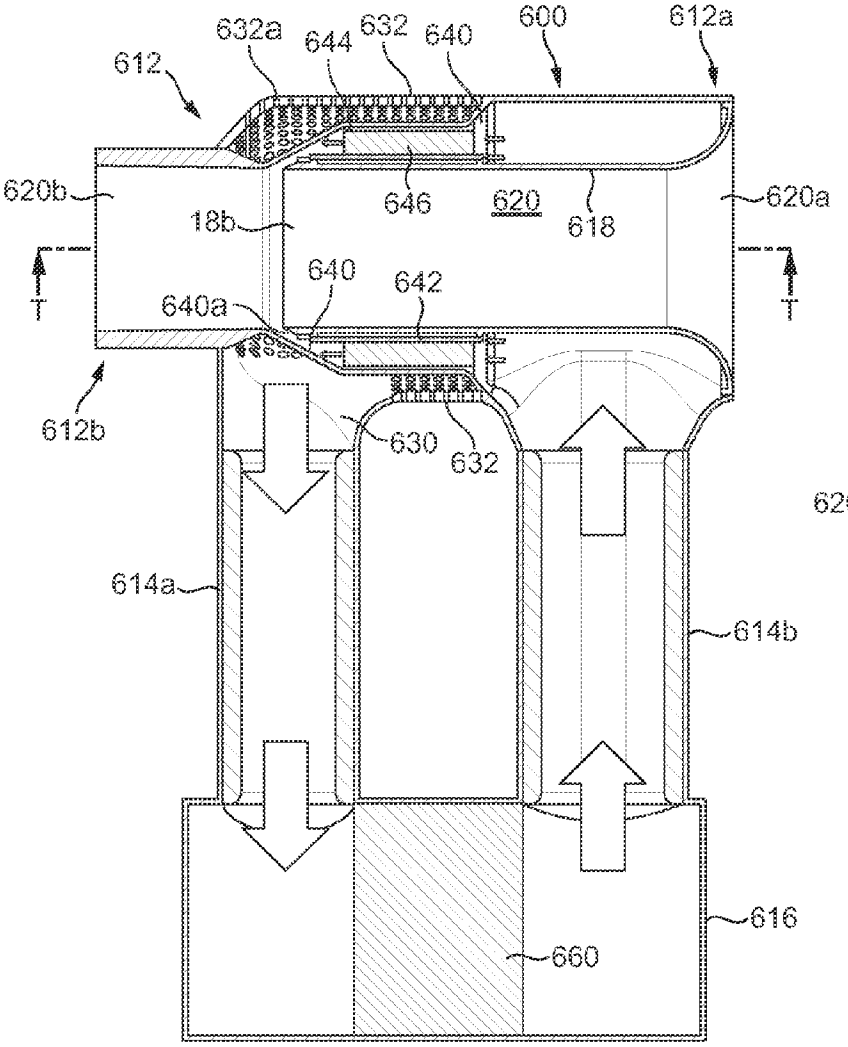
FIG. 28 shows a cross section through an appliance according to the invention.

FIGS. 28 and 29 show an alternate appliance 600 according to the invention. In this example, there is a first body 612 which defines a fluid flow path 620 through the appliance and a pair of ducts 614 which extend from the first body 612 to a second body 616.

The fluid flow path 620 has a fluid intake 620*a* at a rear end 612*a* of the body 612 and a fluid outflow 620*b* at a front end 612*b* of the body 612. Thus, fluid can flow along the whole length of the body 612. The fluid flow path 620 is a central flow path for the body 612 and for at least a part of the length of the body 612 the fluid flow path is surrounded and defined by a tubular housing 618. The tubular housing 618 is a duct, pipe or conduit that the generally longer that it is wide and preferably has a substantially circular cross section, however, it may be oval, square, rectangular or another shape.

A primary fluid flow path 630 is provided having an inlet 632 provided in body 612 spaced apart from the rear end 612*a* of the body. In this example, the inlet 632 is generally annular and comprises a plurality of apertures 632*a*. The apertures 632*a* are spaced and sized so as to act as a filter to dirt and hair ingress. The primary fluid flow path 630 flows from the inlet 632 into the body 612 of the appliance and from there down a duct 614*a*, through the second body 616 and up the other duct 614*b* back into the body 612 and into a third or outlet section of the primary fluid flow path 640. The outlet section of the primary fluid flow path 640 is generally annular to the fluid flow path 620 and is nested between the fluid flow path and primary fluid flow path for at least a part of the length of body 612. Thus for at least a portion of the length of the body 612, there is a three tiered flow path 620, 630, 640.

The second body 616 houses a fan unit 660 which includes a fan and motor for driving the fan. Thus, fluid that flows through the primary fluid flow path 630 is drawn in by the action of the fan unit 660. When the primary flow path 630 returns to the body 612, it becomes an outlet section of the primary fluid flow path 640 which flows between two inner walls 618,644 of the body 612. Housed within the two inner walls 618, 644 of the body is an at least partially annular heater 646 which can heat the fluid that flows through the outlet section of the primary fluid flow path 640. Thus the third or outlet section of the primary fluid flow path 640 is, in this embodiment the directly heated flow.

The heater 646 is preferably annular and is offset from tubular housing 618 by an inner duct 642. The outlet section of the primary fluid flow path has a first flow path 630 through and around the heater 640 and a flow path 640*a* created between the heater 646 and tubular wall 618 by inner wall 642.

When the fan unit is operated, fluid is drawn into the primary fluid flow path 630 at the inlet 632 by the direct action of the fan unit 660. This fluid then flows around a space created between the inlet 632 and inner wall 644 i.e. around the inner wall that surrounds the heater 646 down a first duct 614*a*, through the fan unit 660 and returns to an outlet section of the primary fluid flow path 640 of the body 612 via the second duct 614*b*. The outlet section of the primary fluid flow 640 passes around a heater 646 and when the heater is switched on fluid in the outlet section of the primary fluid flow path 640 is heated by the heater 646. Once the fluid in the outlet section of the primary fluid flow path 640 has passed the heater 646 it exits from the front end 612*b* of the body 612 of the appliance.

When the fan unit 660 is switched on, air is drawn into the intake 632 of the primary flow path 630, through the outlet section of the primary fluid flow path 640 and out of the fluid outflow 612*b* of the body 612. The action of this air being drawn into and out of the body causes fluid to be entrained or induced to flow along the fluid flow path 620. Thus there is one fluid flow (the primary flow path 630) which is actively drawn in by the fan unit and another fluid flow which is created by the fluidic movement caused by the action of the fan unit 660. This means that the fan unit 660 processes a portion of the fluid that is output from the body 612 and the rest of the fluid that flows through the body through the fluid flow path 620 passes through the body 612 without being processed by the fan unit.

The entrained fluid that passes through the fluid flow path 620 exits from a downstream end 618*b* of the tubular housing and combines with the fluid that exits the outlet section of the primary fluid flow path 640*a* near the fluid outlet 612*b* of the body 612. Thus the drawn flow is augmented or supplemented by the entrained flow. In addition, this entrained fluid acts as a moving insulator, or a cooling flow for the tubular housing 618 which is accessible from the rear end 612*a* of the body.

The ducts 614 are used for conveying fluid flow around the appliance. In addition one or both of the ducts 614*a*, 614*b* additionally comprises a handle for a user to hold whilst using the appliance. The duct 614*a*, 614*b* may comprise a grippable portion on at least a part of the duct that acts as a handle to assist a user holding the appliance.

The outlet section of the primary fluid flow path 640 is surrounded and defined by a wall 644, 644*a*. For part of the outlet section of the primary fluid flow path the surrounding wall is the outer wall 644*a* of the body, however in the region of the heater 646, this surrounding wall is an internal wall 644 and the outer wall of the body is the inlet 632 of the primary fluid flow path 630. Thus fluid that is drawn into the primary fluid flow path 630 provides a cooling flow for the wall 644, 644*a* which surrounds the heater 646 and outlet section of the primary fluid flow path 640. In addition, this results in fluid that flows along the primary fluid flow path 630 being pre-warmed by the heater before it is processed by the fan unit 660 and directly heated by the heater 646 i.e. it is fluid that is processed or drawn in by the fan unit 660 which is directly heated by the heater. Also, fluid that flows along the primary fluid flow path 630 acts as a moving fluid insulator for the outer wall 644, 632 of the body 612.

For all the embodiments described, the inner opening at one or other end of the appliance can be used to store the appliance for example, by hooking the inner opening onto a retainer such as a hook or nail for convenient storage and retrieval as required.

In all the embodiments described herein, the heater 46, 96, 296, 382, 388, 392, 646 is inaccessible from one or more of the inlet and outlet of the appliance. Referring to FIG. 12 for simplicity, at the inlet end 12*a* of the body 12 the tubular housing 18 surrounds the internal surface of the heater 46, thus any foreign object that enters the inlet will not directly contact the heater. In fact, when the fan unit is switched on, anything loose that enters the inlet will be drawn in and through the body by the entrained fluid. The heater outlet is at least 20 mm, 30 mm, 40 mm, 50 mm or 56 mm from the inlet and/or outlet end of the body of the hairdryer.

At the outlet 12*b*, depending on the configuration of the internal ducting, there may be a small indirect passage to the heater but as the downstream end 18*b* of the tubular housing 18 is further downstream that the heater 46 anything inserted would not have a direct line of sight to the heater and would have to be thinner and longer than say a child's finger to reach the heater. In addition when the appliance is switched on entrained fluid will be blowing the other way, accidental ingress of objects at this end 12*b* is unlikely. Obviously, the downstream end 18*b* of the tubular housing will be hot when the heater is on but not as hot as the heater. This is useful from a safety aspect. If something is inserted into the appliance, it cannot contact the heater directly.

In the embodiments shown in FIGS. 18,19 and 27 as the tubular housing 218, 394 extends for the whole length of the body 12, there is only a small annular opening for access to the heater.

The invention has been described in detail with respect to a hairdryer however, it is applicable to any appliance that draws in a fluid and directs the outflow of that fluid from the appliance.

The appliance can be used with or without a heater; the action of the outflow of fluid at high velocity has a drying effect.

The fluid that flows through the appliance is generally air, but may be a different combination of gases or gas and can include additives to improve performance of the appliance or the impact the appliance has on an object the output is directed at for example, hair and the styling of that hair.

The invention is not limited to the detailed description given above. Variations will be apparent to the person skilled in the art.

The invention claimed is:

1. A hairdryer comprising a body having a first annular wall and a second annular wall extending about the first annular wall, the first annular wall at least partially defining a bore extending through the body, a fluid flow path extending through the bore from a first fluid inlet through which a first fluid flow enters the hairdryer to a first fluid outlet for emitting the first fluid flow from the hairdryer, a primary fluid flow path extending at least partially through the body and from a second fluid inlet through which a primary fluid flow enters the hairdryer to a second fluid outlet, the primary fluid flow path comprising, within the body, a first section and a second section, and a heater located in the second section of the primary fluid flow path upstream of the second fluid outlet, wherein the first section of the primary fluid flow path is arranged to direct fluid over an internal surface of at least one of the annular walls, and wherein the first section of the primary fluid flow path is arranged upstream of, or in parallel with, the second section of the primary fluid flow path.

2. The hairdryer of claim 1, wherein the first section is upstream of the second section.

3. The hairdryer of claim 2, wherein the first section is arranged to direct fluid over the internal surface of the second annular wall.

4. The hairdryer of claim 3, wherein the first section is arranged to direct fluid over the internal surface of the first annular wall.

5. The hairdryer of claim 2, comprising a fan unit located in the fluid flow path, and wherein the fan unit is located downstream of the first section and upstream of the second section.

6. The hairdryer of claim 2, comprising a duct for conveying fluid from the first section to the second section.

7. The hairdryer of claim 6, comprising a handle, and wherein the duct extends through the handle.

8. The hairdryer of claim 1, wherein the primary fluid flow path comprises, within the body, a third section arranged to direct fluid over an internal surface of one of the annular walls.

9. The hairdryer of claim 8, wherein the third section is arranged to direct fluid over an internal surface of the first annular wall.

10. The hairdryer of claim 8, wherein the third section is arranged upstream of the second section.

11. The hairdryer of claim 10, wherein the third section is in parallel with the first section.

12. The hairdryer of claim 8, wherein the third section is in parallel with the second section.

13. The hairdryer of claim 12, wherein the second section and the third section of the primary fluid flow path merge upstream of the second fluid outlet.

14. The hairdryer of claim 1, wherein the second fluid inlet is located in the body.

15. The hairdryer of claim 14, wherein the first annular wall at least partially defines the second fluid outlet.

16. The hairdryer of claim 1, wherein the second fluid outlet is arranged to emit fluid into the fluid flow path.

17. The hairdryer of claim 1, wherein the second fluid outlet extends about the fluid flow path.

18. The hairdryer of claim 1, wherein the second fluid outlet is annular.

19. The hairdryer of claim 1, wherein the second fluid outlet is arranged to emit fluid into the fluid flow path.

20. The hairdryer of claim 1, wherein the second fluid outlet extends about the first fluid outlet.

21. The hairdryer of claim 1, wherein the bore extends from the first fluid inlet through which a first fluid flow enters the hairdryer to the first fluid outlet for emitting the first fluid flow from the hairdryer.

22. The hairdryer of claim 12, wherein the third section is a closed path.

23. A hairdryer comprising a body having a first annular wall and a second annular wall extending about the first annular wall, the first annular wall at least partially defining a bore extending through the body, a fluid flow path extending through the bore from a first fluid inlet through which a first fluid flow enters the hairdryer to a first fluid outlet for emitting the first fluid flow from the hairdryer, a primary fluid flow path extending at least partially through the body and from a second fluid inlet through which a primary fluid flow enters the hairdryer to a second fluid outlet, the primary fluid flow path comprising, within the body, a first section and a second section, and a heater located in the second section of the primary fluid flow path, wherein the first section of the primary fluid flow path is arranged to direct fluid over an internal surface of at least one of the annular walls, wherein the first section of the primary fluid flow path is arranged upstream of, or in parallel with, the second section of the primary fluid flow path, and wherein fluid is emitted from the hairdryer through each of the first fluid outlet of the fluid flow path and the second fluid outlet of the primary fluid flow path.

24. A hairdryer comprising a body having a first annular wall and a second annular wall extending about the first annular wall, the first annular wall at least partially defining a bore extending through the body, a fluid flow path extending through the bore from a first fluid inlet through which a first fluid flow enters the hairdryer to a first fluid outlet for emitting the first fluid flow from the hairdryer, a primary fluid flow path extending at least partially through the body and from a second fluid inlet through which a primary fluid flow enters the hairdryer to a second fluid outlet, the primary fluid flow path comprising, within the body, a first section and a second section, and a heater located in the second section of the primary fluid flow path, wherein the first section of the primary fluid flow path is arranged to direct fluid over an internal surface of at least one of the annular walls, wherein the first section of the primary fluid flow path is arranged upstream of, or in parallel with, the second section of the primary fluid flow path, and wherein the fluid flow path and the primary fluid flow path are isolated within the hairdryer.

* * * * *